US010573219B2

(12) United States Patent
Morita

(10) Patent No.: US 10,573,219 B2
(45) Date of Patent: Feb. 25, 2020

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/191,828

(22) Filed: Nov. 15, 2018

(65) Prior Publication Data

US 2019/0147789 A1 May 16, 2019

(30) Foreign Application Priority Data

Nov. 16, 2017 (JP) ..... 2017-220737

(51) Int. Cl.
*G09G 3/20* (2006.01)

(52) U.S. Cl.
CPC ..... *G09G 3/2011* (2013.01); *G09G 2310/027* (2013.01); *G09G 2310/0291* (2013.01)

(58) Field of Classification Search
CPC ..... G09G 3/2011; G09G 2310/027; G09G 2310/0291
See application file for complete search history.

(56) References Cited

U.S. PATENT DOCUMENTS

| | | | | |
|---|---|---|---|---|
| 5,731,774 | A * | 3/1998 | Fujii | H03M 1/682 341/144 |
| 6,014,122 | A | 1/2000 | Hashimoto | |
| 2002/0126106 | A1 | 9/2002 | Naito | |
| 2006/0132344 | A1 | 6/2006 | Ishii et al. | |
| 2007/0126689 | A1 | 6/2007 | Ishii et al. | |
| 2008/0266231 | A1 | 10/2008 | Umeda | |
| 2008/0303770 | A1 | 12/2008 | Oke et al. | |
| 2012/0313701 | A1 * | 12/2012 | Khlat | H02M 3/07 330/127 |
| 2013/0342520 | A1 | 12/2013 | Tsuchi | |
| 2015/0049073 | A1 | 2/2015 | Morita | |
| 2015/0213757 | A1 * | 7/2015 | Takahama | G09G 3/3266 345/691 |
| 2016/0111035 | A1 | 4/2016 | Morita | |
| 2016/0133218 | A1 | 5/2016 | Morita | |
| 2016/0133219 | A1 | 5/2016 | Morita | |

FOREIGN PATENT DOCUMENTS

| | | | |
|---|---|---|---|
| JP | H04-55889 | A | 2/1992 |
| JP | H10-260664 | A | 9/1998 |
| JP | 2001-67047 | A | 3/2001 |
| JP | 2005-292856 | A | 10/2005 |

(Continued)

*Primary Examiner* — Shaheda A Abdin
(74) *Attorney, Agent, or Firm* — Oliff PLC

(57) ABSTRACT

A display driver includes a first digital-to-analog (D/A) converter circuit configured to convert upper-bit data of display data into a gradation voltage corresponding to the upper-bit data, a second digital-to-analog (D/A) converter circuit configured to output a reference voltage that is varied in accordance with lower-bit data of the display data, and an inverting amplifier circuit configured to amplify the gradation voltage with reference to the reference voltage and to drive a data line of an electro-optical panel.

7 Claims, 14 Drawing Sheets

(56) References Cited

FOREIGN PATENT DOCUMENTS

| | | | |
|---|---|---|---|
| JP | 2006-197532 | A | 7/2006 |
| JP | 2007-158810 | A | 6/2007 |
| JP | 2007-219091 | A | 8/2007 |
| JP | 2008-65301 | A | 3/2008 |
| JP | 2008-295018 | A | 12/2008 |
| JP | 2008-304806 | A | 12/2008 |
| JP | 2015-38543 | A | 2/2015 |
| JP | 2016-80807 | A | 5/2016 |
| JP | 2016-90881 | A | 5/2016 |
| JP | 2016-90882 | A | 5/2016 |
| JP | 2017-156769 | A | 9/2017 |
| WO | 2012/121087 | A1 | 9/2012 |

* cited by examiner

DISPLAY DRIVER, ELECTRO-OPTICAL DEVICE, AND ELECTRONIC APPARATUS

BACKGROUND

1. Technical Field

The invention relates to a display driver, an electro-optical device, and an electronic apparatus.

2. Related Art

A display driver for driving an electro-optical panel includes a ladder resistance circuit for generating a plurality of voltages, a digital-to-analog (D/A) converter circuit for selecting a gradation voltage corresponding to display data from the plurality of voltages, and an amplifier circuit for amplifying or buffering (executing impedance conversion on) the gradation voltage. A related technology of such a display driver is disclosed in, for example, JP-A-2005-292856, JP-A-2001-67047, and JP-A-10-260664.

In JP-A-2005-292856, the amplifier circuit is formed of a forward amplifier circuit. That is, a gradation voltage is input to a non-inverting input terminal (positive terminal) of an operational amplifier, and a feedback voltage is input to an inverting input terminal (negative terminal).

In JP-A-2001-67047 and JP-A-10-260664, the amplifier circuit is formed of an inverting amplifier circuit. A first capacitor is provided between an input node of the inverting amplifier circuit and an inverting input terminal of an operational amplifier. A second capacitor is provided between the inverting input terminal and an output terminal of the operational amplifier. A gradation voltage is input to a non-inverting input terminal of the operational amplifier.

In a case where a non-inverting amplifier circuit as in JP-A-2005-292856 or a voltage follower circuit is adopted as an amplifier circuit of a display driver, a bias point of a differential pair of the operational amplifier fluctuates in accordance with the gradation. A gain of a differential pair generally fluctuates when a bias point fluctuates. Thus, it is difficult to achieve a high gain over the entire fluctuation range of the bias point. A technique using the inverting amplifier circuits disclosed in JP-A-2001-67047 and JP-A-10-260664 is conceivable, for example, to reduce a fluctuation of the bias point of such a differential pair.

For example, displaying in multiple gradation levels is occasionally required for a high-performance display device such as a projector. Voltage difference per one gradation, made small when displaying in multiple gradation levels, needs to be output with high precision. Unfortunately, in a case where an inverting amplifier circuit is adopted as the amplifier circuit as described above, the related arts have not made any artifice or device for achieving multiple gradations.

SUMMARY

According to some aspects of the invention, there are provided, a display driver, an electro-optical device, an electronic apparatus, and the like capable of achieving multiple gradations when adopting an inverting amplifier circuit as the amplifier circuit.

One aspect of the invention is related to a display driver including a first digital-to-analog (D/A) converter circuit configured to convert upper-bit data of display data into a gradation voltage corresponding to the upper-bit data, a second digital-to-analog (D/A) converter circuit configured to output a reference voltage that is varied in accordance with lower-bit data of the display data, and an inverting amplifier circuit configured to amplify the gradation voltage with reference to the reference voltage and to drive a data line of an electro-optical panel.

According to one aspect of the invention, the upper-bit data of the display data are converted into a gradation voltage by the first D/A converter circuit, and the reference voltage that is varied in accordance with the lower-bit data of the display data is output by the second D/A converter circuit, and the gradation voltage is amplified, with reference to the reference voltage, by the inverting amplifier circuit. This allows the output voltage of the inverting amplifier circuit to be varied in accordance with the lower-bit data. In other words, each gradation of the upper-bit data can be further divided with the lower-bit data, enabling the number of gradations to be increased. In this way, multiple gradations can be achieved when adopting an inverting amplifier circuit.

In one aspect of the invention, the second D/A converter circuit may output a voltage corresponding to the lower-bit data as a reference voltage among $2^m$ voltages obtained by dividing a difference between two voltages, the difference being represented by $\Delta V \times |G|/(1+|G|)$, by $2^m$ provided that the lower-bit data are m bits (m is an integer of 1 or greater), that a gain of the inverting amplifier circuit is G, and that a voltage difference corresponding to one gradation of the gradation voltage is $\Delta V$.

This allows the second D/A converter circuit to output the reference voltage corresponding to the lower-bit data of the display data, so that the voltage difference of the output voltage of the inverting amplifier circuit corresponding to one gradation of the upper-bit data of the display data can be divided by $2^m$. Accordingly, multiple gradations for m bits with respect to the upper-bit data can be achieved.

One aspect of the invention may further include a first current compensating circuit provided between an input node of the inverting amplifier circuit and a node of a high electric potential side-power supply voltage, the first current compensating circuit being configured to cause a first compensating current to flow from a node of the high electric potential side-power supply voltage to the input node of the inverting amplifier circuit, and a second current compensating circuit provided between the input node of the inverting amplifier circuit and a node of a low electric potential side-power supply voltage, the second current compensating circuit being configured to cause a second compensating current to flow from the input node of the inverting amplifier circuit to a node of the low electric potential side-power supply voltage, wherein the inverting amplifier circuit includes an operational amplifier including a non-inverting input terminal to which the reference voltage is input, a first resistor provided between the input node to which the gradation voltage is input and an inverting input terminal of the operational amplifier, and a second resistor provided between an output terminal of the operational amplifier and the inverting input terminal.

This allows the first current compensating circuit to cause the first compensating current to flow from the node of the high electric potential side-power supply voltage to the input node of the inverting amplifier circuit and allows the second current compensating circuit to cause the second compensating current to flow from the input node of the inverting amplifier circuit to the node of the low electric potential side-power supply voltage. Thus, the current flowing between the input node of the inverting amplifier circuit and the ladder resistance circuit through the D/A converter circuit can be compensated (reduced or canceled). Accordingly, an error in a gradation voltage output from the D/A converter circuit can be reduced (or canceled) while adopting an inverting amplifier circuit including first and second resistors provided as a feedback circuit between the input node and the output node.

Another aspect of the invention is related to a display driver including a digital-to-analog (D/A) converter circuit configured to convert upper-bit data of display data to a gradation voltage corresponding to the upper-bit data, an inverting amplifier circuit configured to amplify the gradation voltage and to drive a data line of an electro-optical panel, and a current supply circuit configured to supply a current corresponding to lower-bit data of the display data to an input node or an output node of the inverting amplifier circuit.

According to another such aspect of the invention, a current corresponding to the lower-bit data of the display data is supplied from the current supply circuit to the input node of the inverting amplifier circuit, then, a voltage of the input node of the inverting amplifier circuit is varied. Further, the current corresponding to the lower-bit data of the display data is supplied from the current supply circuit to the output node of the inverting amplifier circuit, then, a voltage of an inverting input terminal of the operational amplifier is varied and an output voltage of the inverting amplifier circuit is varied. Accordingly, the inverting amplifier circuit can output the output voltage corresponding to the lower-bit data of the display data. In other words, each gradation of the upper-bit data can be further divided with the lower-bit data, enabling the number of gradations to be increased. In this way, multiple gradations can be achieved when adopting an inverting amplifier circuit.

Such another aspect of the invention may further include a ladder resistance circuit configured to generate a plurality of voltages, wherein the D/A converter circuit may be configured to select a voltage corresponding to the upper-bit data as the gradation voltage from the plurality of voltages and to output the gradation voltage to the input node of the inverting amplifier circuit, and wherein the current supply circuit may be configured to supply the current to the ladder resistance circuit via the D/A converter circuit.

A current supplied from the current supply circuit to the ladder resistance circuit causes the current flowing through the resistance forming the ladder resistance circuit to be varied, then, the gradation voltage is varied. This allows the voltage difference of the gradation voltage per one gradation of the upper-bit data of the display data to be divided by $2^m$ with the lower-bit data of the display data.

In such another aspect of the invention, the inverting amplifier circuit may further include an operational amplifier including an output terminal coupled to the output node of the inverting amplifier circuit, wherein the current supply circuit may be configured to supply the current to the output terminal of the operational amplifier.

This allows a current to flow from the current supply circuit to the output terminal of the operational amplifier, so that a current flows through the output unit of the operational amplifier and a voltage of the inverting input terminal of the operational amplifier is varied. Accordingly, the output voltage of the inverting amplifier circuit can be controlled by the current from the current supply circuit, enabling a voltage difference per one gradation of the upper-bit data to be divided by $2^m$ with the lower-bit data.

Further, still another aspect of the invention is related to a display driver including a digital-to-analog (D/A) converter circuit configured to convert upper-bit data of display data to a gradation voltage corresponding to the upper-bit data, a voltage output circuit to which lower-bit data of the display data are input, and an inverting amplifier circuit configured to amplify the gradation voltage and to drive a data line of the electro-optical panel, wherein the inverting amplifier circuit includes an operational amplifier in which a voltage obtained by dividing a voltage between the gradation voltage and an output voltage of the inverting amplifier circuit is input to an inverting input terminal, wherein the operational amplifier includes first to p-th transistors (p is an integer of 2 or greater) that are coupled in parallel with each other as transistors of a differential pair corresponding to a non-inverting input terminal, and the voltage output circuit is configured to select either one of a first reference voltage and a second reference voltage that is different from the first reference voltage as each of the output voltages of the first to p-th transistors based on the lower-bit data and to output the output voltages of the first to p-th transistors to gates of the first to p-th transistors.

According to such another aspect of the invention, each of the first to p-th output voltages input to the first to p-th transistors corresponding to a non-inverting input terminal of an operational amplifier is selected, based on the lower-bit data, from the first and second reference voltages. This allows the voltage of the inverting input terminal of the operational amplifier to be varied, enabling the inverting amplifier circuit to output the output voltage corresponding to the lower-bit data. Accordingly, each gradation of the upper-bit data can be further divided with the lower-bit data, enabling the number of gradations to be increased.

In such another aspect of the invention, a voltage difference between the first reference voltage and the second reference voltage may be represented by $\Delta V \times |G|/(1+|G|)$ provided that the lower-bit data are m bits (m is an integer of 1 or greater), that the gain of the inverting amplifier circuit is G, and that the voltage difference corresponding to one gradation of the gradation voltage is $\Delta V$.

This allows the voltage output circuit to select, based on the lower-bit data, either the first or the second reference voltage as each of the output voltages of the first to p-th output voltages, enabling the voltage difference of the output voltage of the inverting amplifier circuit corresponding to one gradation of the upper-bit data of the display data to be divided by $2^m$. Accordingly, multiple gradations for m bits with respect to the upper-bit data can be achieved.

In such another aspect of the invention, the inverting amplifier circuit may further include a first resistor provided between an input node of the inverting amplifier circuit to which the gradation voltage is input and an inverting input terminal of the operational amplifier, and a second resistor provided between an output terminal of the operational amplifier and the inverting input terminal.

This allows an inverting amplifier circuit to be formed, in which the first and second resistors are provided as a feedback circuit between the input node and the output node. According to such another aspect of the invention, multiple gradations can be achieved even when adopting such an inverting amplifier circuit.

Further, still another aspect of the invention is related to an electro-optical device including the display driver described in any one of the descriptions above, and an electro-optical panel that is driven by the display driver.

Further, still another aspect of the invention is related to an electronic apparatus including the display driver described in any one of the descriptions above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some exemplary embodiments of the invention will be described in detail hereinafter. Note that the exemplary embodiments described hereinafter are not intended to limit the content of the invention as set forth in the claims, and not all of the configurations described in the exemplary embodiments are absolutely required to address the issues described in the invention.

1. First Configuration Example of Display Driver

Figure 1:
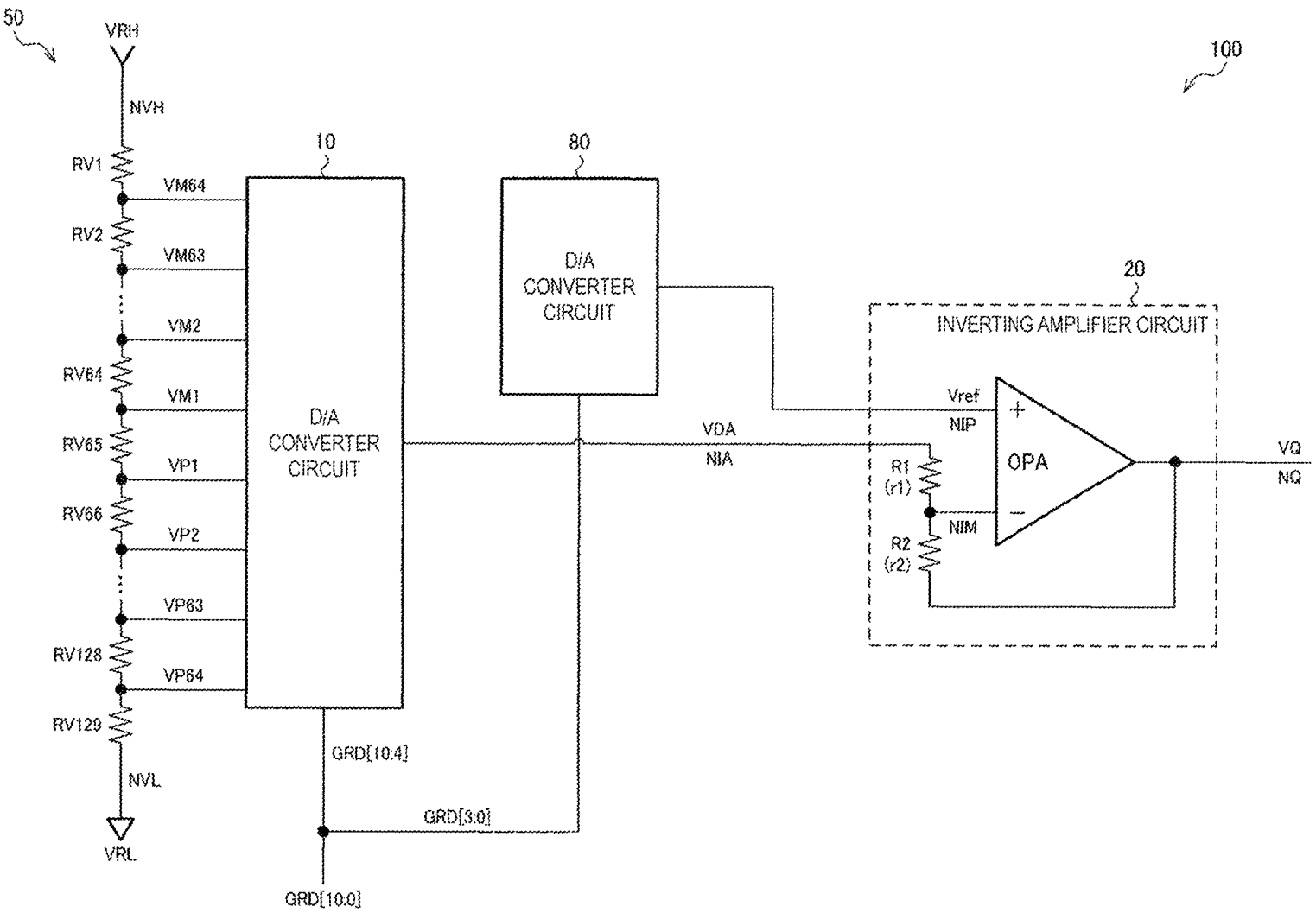
FIG. 1 is a first configuration example of a display driver of the exemplary embodiment.

FIG. 1 is a first configuration example of a display driver 100 of the exemplary embodiment. The display driver 100 includes a digital-to-analog (D/A) converter circuit 10 (first D/A converter circuit), an inverting amplifier circuit 20, and a digital-to-analog (D/A) converter circuit 80 (second D/A converter circuit). The display driver 100 may further include a ladder resistance circuit 50 (gradation voltage generating circuit). Note that the exemplary embodiment is not limited to the configuration in FIG. 1, and various modifications can be achieved by, for example, omitting a part of the components or adding another component.

Display data are n+m bits of data. Hereinafter, n bits of data from the most significant bit (MSB) side is referred to as upper-bit data and m bits of data from the least significant bit (LSB) side is referred to as lower-bit data. In FIG. 1, display data GRD [10:0] are 11 bits of data, upper-bit data GRD [10:4] are 7 bits of data, and lower-bit data GRD [3:0] are 4 bits of data. It is noted that n and m may each be, not limited to the above, an integer of 1 or greater.

The D/A converter circuit 10 converts the upper-bit data GRD [10:4] of the display data into a gradation voltage VDA corresponding to the upper-bit data GRD [10:4]. In other words, the D/A converter circuit 10 selects a voltage corresponding to the upper-bit data GRD [10:4] from a plurality of voltages VP1 to VP64 and VM1 to VM64 and outputs the selected voltage as the gradation voltage VDA. Specifically, in a case where GRD [10:4]=0000000, 0000001, . . . , 0111111, respective negative driving voltages VM64, VM63, . . . , VM1 are output as the gradation voltage VDA. In a case where GRD [10:4]=1000000, 1000001, . . . , 1111111, respective positive driving voltages VP1, VP2, . . . , VP64 are output as the gradation voltage VDA. Note that GRD [10:4] is expressed in binary herein. In polarity inversion driving that inverts a drive polarity for every pixel, line, or frame, the positive driving voltages VP1 to VP64 are selected for positive driving, and the negative driving voltages VM1 to VM64 are selected for negative driving.

For example, the D/A converter circuit 10 is formed of a decoder for decoding the upper-bit data GRD [10:4] and a switch circuit controlled by the decoder. The switch circuit, which includes a plurality of switches (for example, transistors), selects either one of the voltages VM64 to VM1 or VP1 to VP64 when each switch is turned on or off, and outputs the selected voltage as the gradation voltage VDA. The decoder decodes the upper-bit data GRD [10:4] into a control signal for selecting the voltage corresponding to the upper-bit data GRD [10:4]. The control signal is used to control the plurality of switches of the switch circuit to be turned on or off, and the voltage corresponding to the upper-bit data GRD [10:4] is selected by the switch circuit.

The inverting amplifier circuit 20 amplifies the gradation voltage VDA with reference to a reference voltage Vref and drives data lines of the electro-optical panel. In other words, a voltage (VQ) obtained by amplifying the gradation voltage VDA is output as a data voltage from data voltage output terminals of the display driver 100 to the data lines of the electro-optical panel. When a gain of the inverting amplifier circuit 20 is G (<0), the inverting amplifier circuit 20 inverts and amplifies the gradation voltage VDA with a gain G with reference to the reference voltage Vref, and outputs an output voltage VQ (data voltage). The output voltage VQ is output as a data voltage from a terminal of the display driver 100 and drives data lines (source lines) of an electro-optical panel coupled to the display driver 100. For example, VP64<VP63< . . . <VP1 (≤Vref)<VM1<VM2< . . . <VM64. The negative driving voltages VM1 to VM64 are inverted and amplified to be negative data voltages that are lower than the reference voltage Vref. The positive drive voltages VP1 to VP64 are inverted and amplified to be positive data voltages that are higher than the reference voltage Vref.

Specifically, the inverting amplifier circuit 20 includes an operational amplifier OPA, a resistor R1 (first resistor, first resistance element), and a resistor R2 (second resistor, second resistance element). The reference voltage Vref is input to a non-inverting input terminal (positive terminal, non-inverting input node NIP) of the operational amplifier OPA. The resistor R1 is provided between an input node NIA, to which the gradation voltage VDA is input, and an inverting input terminal (negative terminal, inverting input node NIM) of the operational amplifier OPA. The resistor R2 is provided between an output node of the operational amplifier OPA (output node NQ of the inverting amplifier circuit 20) and the inverting input terminal of the operational amplifier OPA. A voltage obtained by dividing a voltage between the gradation voltage VDA and the output voltage VQ (voltage divided by the resistors R1 and R2) is input to the inverting input terminal of the operational amplifier OPA. The gain of the inverting amplifier circuit 20 is represented by G=−r2/r1 provided that the resistors R1 and R2 respectively have resistance values r1 and r2.

The D/A converter circuit 80 outputs a reference voltage Vref that is varied in accordance with the lower-bit data GRD [3:0] of the display data to the non-inverting input terminal of the operational amplifier OPA. The gradation voltage VDA with respect to predefined upper-bit data GRD [10:4] is input to the input node NIA of the inverting amplifier circuit 20. At this time, the output voltage VQ of the inverting amplifier circuit 20 is varied in accordance with the variation of the reference voltage Vref. When voltage change per one gradation in the output voltage VQ is defined as ΔVQ, ΔVQ is defined as being divided into $2^4$ ($2^m$). The D/A converter circuit 80 generates $2^4$ voltages corresponding to $2^4$ division voltages on the output voltage VQ side. Then, among the $2^4$ voltages, the voltage corresponding to the lower-bit data GRD [3:0] is output as the reference voltage Vref. This allows the output voltage VQ corresponding to the display data GRD [10:0] including the lower-bit data GRD [3:0] to be output.

For example, the D/A converter circuit 80 is formed of a decoder for decoding the lower-bit data GRD [3:0], a switch circuit controlled by the decoder, and a ladder resistance circuit for generating $2^4$ voltages. The switch circuit, which includes a plurality of switches (for example, transistors), outputs any one of the $2^4$ voltages as the reference voltage Vref when each of the switches is turned on or off. For example, the voltage VP1 is input from the ladder resistance circuit 50 to one end of the ladder resistance circuit of the D/A converter circuit 80, and the voltage VM1 is input from the ladder resistance circuit 50 to the other end of the ladder resistance circuit of the D/A converter circuit 80. The ladder resistance circuit of the D/A converter circuit 80 divides a voltage between the voltage VP1 and a given voltage to generate $2^4$ voltages. As described below, the given voltage is varied in accordance with the gain G of the inverting amplifier circuit 20. The decoder decodes the lower-bit data GRD [3:0] into a control signal for selecting the voltage corresponding to the lower-bit data GRD [3:0]. The control signal is used to control a plurality of switches of the switch circuit to be turned on or off, and a voltage corresponding to the lower-bit data GRD [3:0] is selected by the switch circuit.

According to the above exemplary embodiments, the D/A converter circuit 10 converts the upper-bit data GRD [10:4] of the display data into the gradation voltage VDA, and the inverting amplifier circuit 20 amplifies the gradation voltage VDA. The D/A converter circuit 80 outputs the reference voltage Vref that is varied in accordance with the lower-bit data GRD [3:0] of the display data, and this enables the output voltage VQ of the inverting amplifier circuit 20 to be varied in accordance with the lower-bit data GRD [3:0]. This allows each gradation of the upper-bit data GRD [10:4] to be further divided with the lower-bit data GRD [3:0], enabling the number of gradations to be increased. For example, the voltage difference of one gradation decreases when the number of gradations is to be increased using only the ladder resistance circuit 50, making it difficult to obtain a high-precision gradation voltage (or an increase in gradation number itself), or enlarging the circuit scale of the D/A converter circuits. In this regard, the reference voltage Vref is varied to divide each gradation of the upper-bit data GRD [10:4], and this enables multiple gradations to be achieved while suppressing the circuit scale of the D/A converter circuit.

In a forward amplifier circuit and a voltage follower circuit, the input voltage is input to the non-inverting input terminal of the operational amplifier, and the inverting input terminal is used for feedback. For this reason, a technique allowing the reference voltage Vref to be varied as in the exemplary embodiment can not be adopted. In other words, a technique of the exemplary embodiment is a technique in which multiple gradations can be achieved when adopting the inverting amplifier circuit 20 in which the reference voltage Vref is input to the non-inverting input terminal of the operational amplifier.

The inverting amplifier circuit 20 is adopted in such manner to limit an operating point of a differential pair of the operational amplifier OPA to the reference voltage Vref (voltage in the vicinity of the reference voltage Vref). This eliminates a need to secure sensitivity (gain) of the operational amplifier OPA in a wide range of input voltage, and the operational amplifier OPA can thus be made to be highly sensitive (highly gained). Further, the inverting amplifier circuit 20 is adopted in such manner to improve a frequency response characteristic (expand a band) in comparison with a case where a voltage follower circuit is used for output of a data voltage. The reason is that a phase of the output is rotated 180 degrees with respect to a phase of the input and a band that can secure a phase margin is thus broadened.

Figure 2:
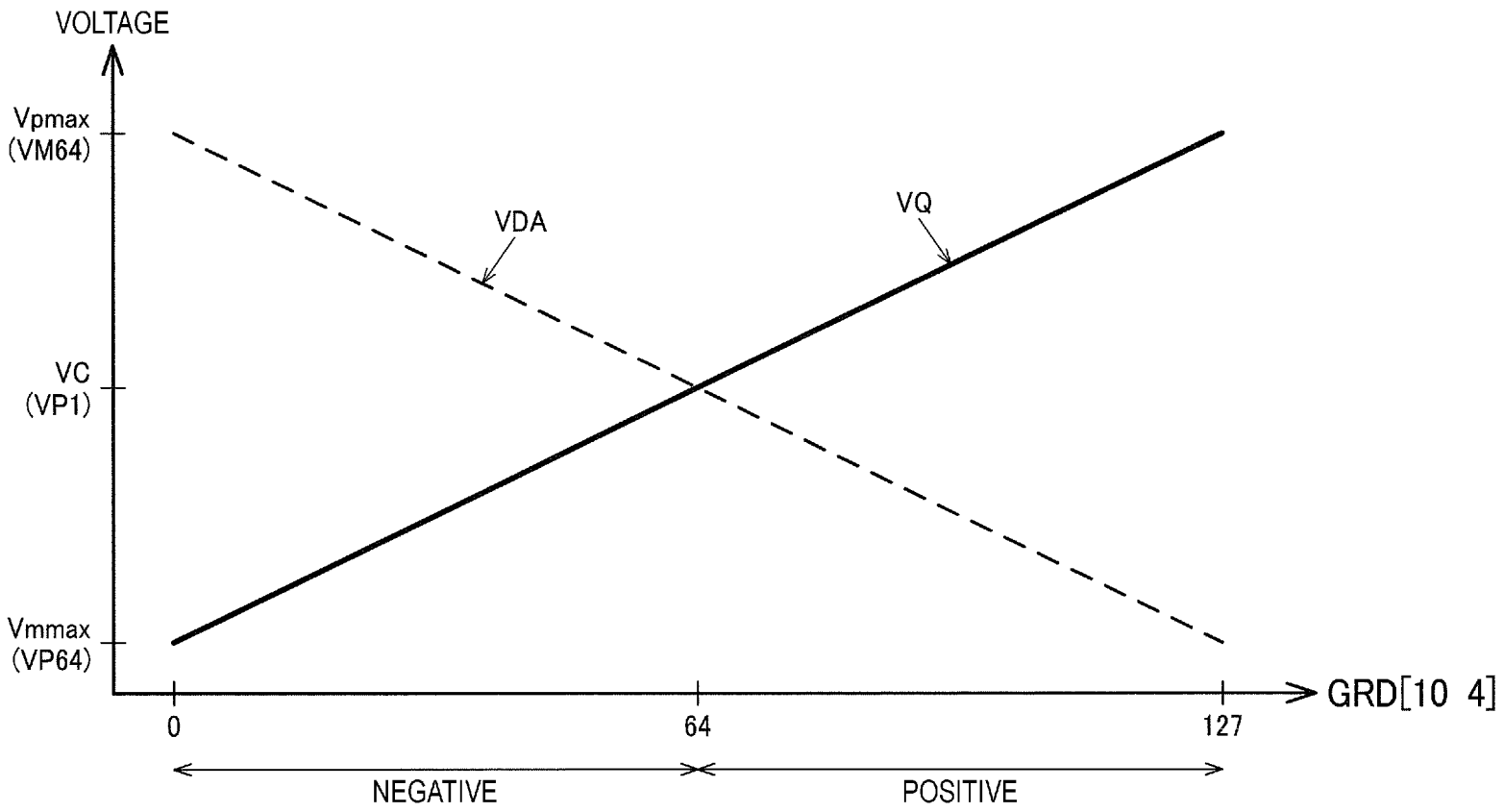
FIG. 2 is a diagram for describing an operation of the display driver of the first configuration example.
Figure 3:
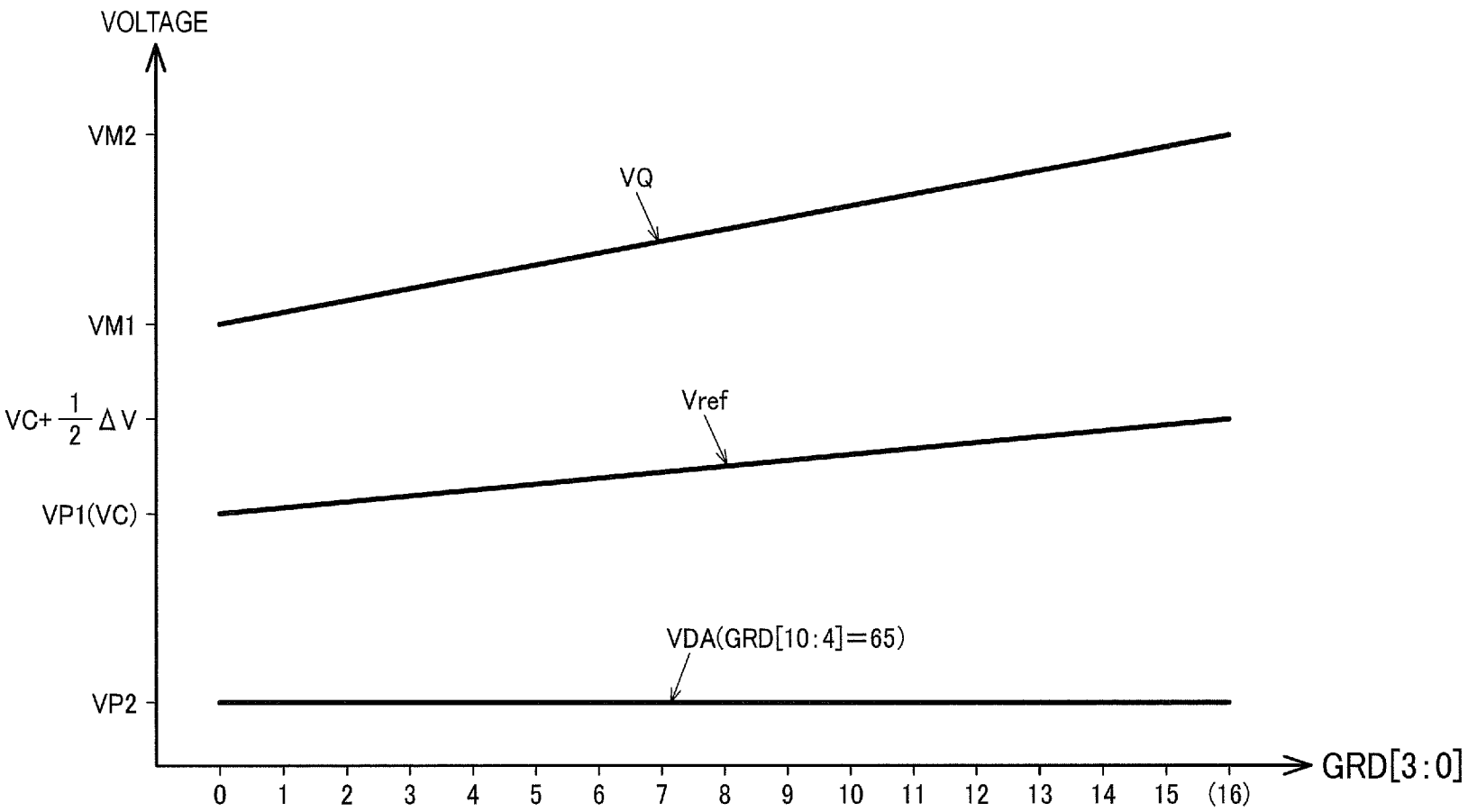
FIG. 3 is a diagram for describing an operation of the display driver of the first configuration example.

FIG. 2 and FIG. 3 are diagrams for describing an operation of the display driver 100 of the exemplary embodiment. In FIG. 2 and FIG. 3, a gradation value of the upper-bit data GRD [10:4] and a gradation value of the lower-bit data GRD [3:0] are both represented by decimal numbers. In addition, a case where the gain of the inverting amplifier circuit 20 is −1 (i.e., r1=r2) will be described as an example. Note that the gain of the inverting amplifier circuit 20 is not limited to −1.

FIG. 2 indicates voltage characteristics in a case where the upper-bit data GRD [10:4] is varied. In FIG. 2, the lower-bit data are set such that GRD [3:0]=0.

As indicated in FIG. 2, the gradation voltage VDA varies linearly, for example, with respect to a gradation value of GRD [10:4]. In a case where GRD [10:4]=0, VDA=VPmax. In a case where GRD [10:4]=64, VDA=VC. In a case where GRD [10:4]=127, VDA=VMmax=VP64. For a data voltage after an inverting amplification, in a case where GRD [10:4]=0, VQ=VMmax, in a case where GRD [10:4]=64, VQ=VC, and in a case where GRD [10:4]=127, VQ=VPmax. Therefore, VQ<VC<VDA in negative gradations (gradation values "0" to "63"), and VQ≥VC≥VDA in positive gradations (gradation values "64" to "127"). Note that VPmax is a maximum positive gradation voltage (gradation voltage farthest from VC) and VMmax is a maximum negative gradation voltage. Also note that VC is the reference voltage Vref in a case where the lower-bit data GRD [3:0]=0, and VC=(VPmax+VMmax)/2. Correspondences with the output voltage of the ladder resistance circuit 50 in FIG. 1 are represented by VPmax=VM64, VMmax=VP64, and VC=VP1.

FIG. 3 indicates voltage characteristics in a case where the lower-bit data GRD [3:0] is varied. Here, a case where the upper-bit data GRD [10:4]=65 and VDA=VP2 will be described as an example. Note that, although GRD [3:0] actually ranges from 0 to 15, up to 16 are illustrated for the description.

In a case where GRD [3:0]=0, the D/A converter circuit 80 outputs the reference voltage Vref=VC (=VP1). Since the inverting amplifier circuit 20 amplifies the gradation voltage VDA=VP2 with the gain of −1 with reference to the reference voltage Vref, the output voltage VQ=VM1. In a case where the upper-bit data GRD [10:4]=66 on a one step higher gradation level, VQ=VM2 for the output voltage of the inverting amplifier circuit 20. Thus, in a case where GRD [3:0]=16, it may be that Vref=(VP2+VM2)/2=VC+(VM1−VP1)/2. Vref=VC+(½)×ΔV provided that ΔV=VM1−VP1. Equally dividing the voltage which is linearly varied from VC to VC+(½)×ΔV by $2^4$ obtains the reference voltage Vref in each gradation of GRD [3:0]. In other words, the D/A converter circuit 80 outputs the reference voltage Vref=VC+i×{(½)×ΔV/$2^4$} provided that GRD [3:0]=i (i is an integer from 0 to 15). For the output voltage of the inverting amplifier circuit 20, VQ=VM1+i×(ΔV/$2^4$), which is a voltage obtained by equally dividing a voltage between VM1 and VM2 by $2^4$.

Note that, although the case where the inverting amplifier circuit 20 has a gain G=−1 is exemplified as above, the reference voltage in a case where GRD [3:0]=16 may be represented, for any gain G<0, by Vref=VC+ΔV×|G|/(1+|G|). In other words, the D/A converter circuit 80 outputs the reference voltage Vref=VC+i×{ΔV×|G|/(1+|G|)/$2^4$}.

According to the above exemplary embodiment, the D/A converter circuit 80 outputs a voltage corresponding to the lower-bit data as the reference voltage Vref among $2^m$ voltages obtained by dividing a difference between two voltages, the difference being represented by ΔV×|G|/(1+|G|), by $2^m$ provided that the lower-bit data of the display data are m bits (m is an integer of 1 or greater), that the gain of the inverting amplifier circuit 20 is G, and that the voltage difference corresponding to one gradation of the gradation voltage VDA is ΔV.

For example, in FIG. 3, m=4 and G=−1. That is, $2^4$ voltages of VC+i×{(½)×ΔV/$2^4$} are obtained by dividing a difference between two voltages VC and VC+(½)×ΔV, the difference being represented by (½)×ΔV, by $2^4$. The D/A converter circuit 80 outputs, as the reference voltage Vref, the voltage corresponding to the lower-bit data GRD [3:0]=i among the $2^4$ voltages.

This allows the D/A converter circuit 80 to output the reference voltage Vref corresponding to the lower-bit data GRD [3:0] of the display data, enabling one gradation of the upper-bit data GRD [10:4] to be divided into $2^4$ ($2^m$). Specifically, the inverting amplifier circuit 20 becomes capable of outputting the output voltage VQ=VM1+i×(ΔV/$2^4$) corresponding to the display data GRD [10:0] including the lower-bit data GRD [3:0]. This makes it possible to achieve multiple gradations for 4(m) bits with respect to the upper-bit data of 7(n) bits.

2. Second Configuration Example of Display Driver

Figure 4:
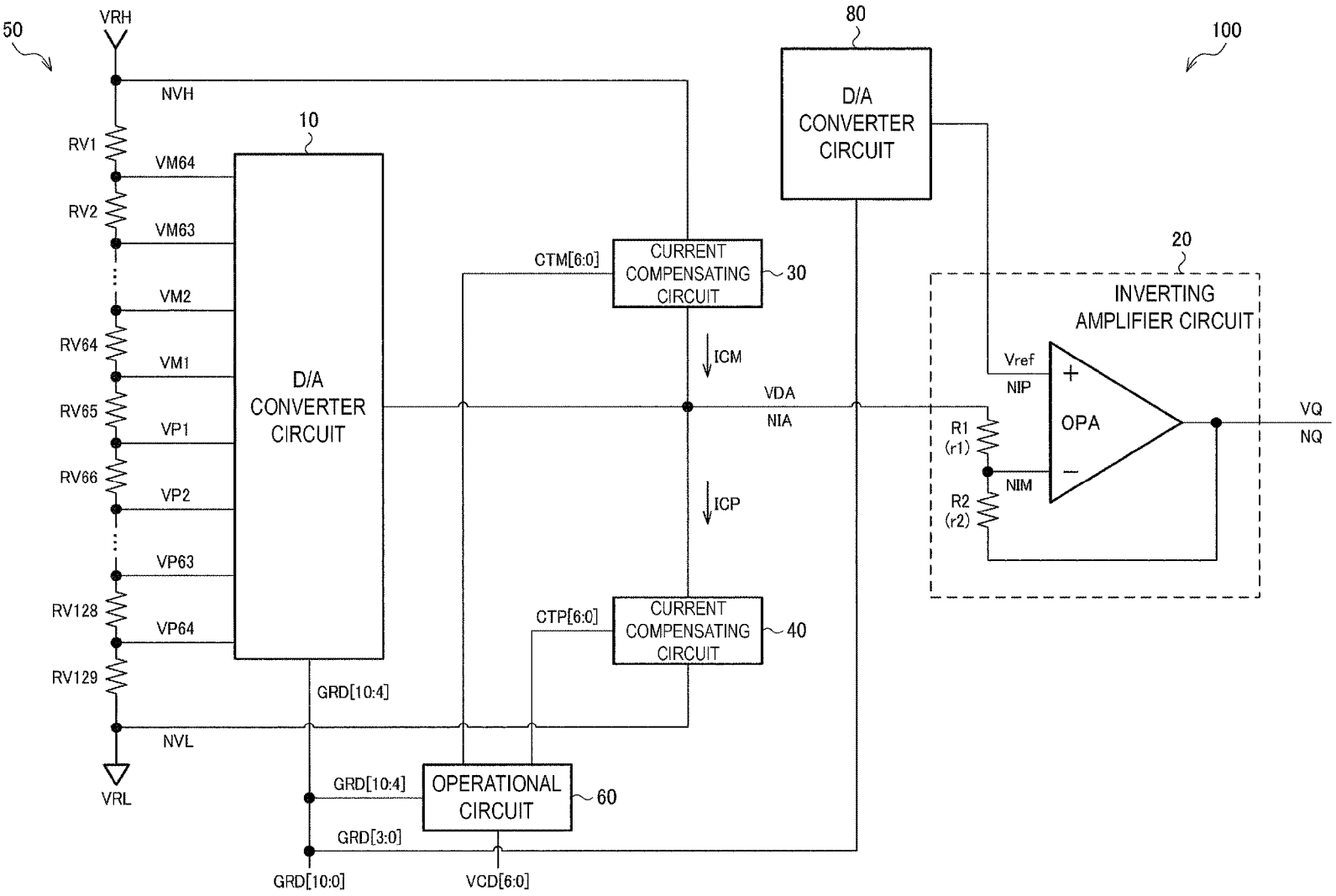
FIG. 4 is a second configuration example of a display driver of the exemplary embodiment.

FIG. 4 is a second configuration example of the display driver 100 of the exemplary embodiment. The display driver 100 in FIG. 4 includes a current compensating circuit 30 (first current compensating circuit), a current compensating circuit 40 (second current compensating circuit), and an operational circuit 60 in addition to the components in FIG. 1. Note that the components that are the same as the components described above are referenced using like numbers, and no descriptions for such components are provided below.

The current compensating circuit 30, which is provided between the input node NIA of the inverting amplifier circuit 20 and a node NVH of a high electric potential side-power supply voltage, causes a compensating current ICM (first compensating current) to flow from the node NVH of the high electric potential side-power supply voltage to the input node NIA of the inverting amplifier circuit 20. The current compensating circuit 40, which is provided between the input node NIA of the inverting amplifier circuit 20 and a node NVL of a low electric potential side-power supply voltage, causes a compensating current ICP (second compensating current) to flow from the input node NIA of the inverting amplifier circuit 20 to the node NVL of the low electric potential side-power supply voltage.

A current flows between the input node NIA and the output node NQ of the inverting amplifier circuit 20 through resistors R1 and R2. In other words, a current of (VQ−VDA)/(r1+r2) flows from the output node NQ to the input node NIA. Compensation currents ICM and ICP are currents for compensating the current. In other words, compensating currents ICM and ICP are currents for reducing (or canceling) the current flowing between the input node NIA and the ladder resistance circuit 50 (node of a voltage selected by the D/A converter circuit 10) through the D/A converter circuit 10.

The operational circuit 60 executes operational processing based on the upper-bit data GRD [10:4], and outputs a setting data CTM [6:0] (first setting data, first setting signal) for setting a current value of the compensating current ICM and a setting data CTP [6:0] (second setting data, second setting signal) for setting a current value of the compensating current ICP. Specifically, the operational circuit 60 outputs the setting data CTM [6:0] and CTP [6:0] based on a difference between the upper-bit data GRD [10:4] and reference data VCD [6:0]. The reference data VCD [6:0] is the same data 0100000 (gradation value "64") as GRD [10:4] for making an output voltage of the D/A converter circuit 10 VDA=VC. For example, the magnitude of the difference (absolute value) between the upper-bit data GRD [10:4] and the reference data VCD [6:0] is output as setting data CTM [6:0] and CTP [6:0]. The operational circuit 60 is realized by a logic circuit. Note that the operational circuit 60 may also be realized by a digital signal processor (DSP) for executing a plurality of processes of digital signal processing in a time-division manner. In this case, the operational processing is executed in the time-division manner together with another digital signal processing.

The current compensating circuit 30 outputs the compensating current ICM having a current value set by the setting data CTM [6:0]. The current compensating circuit 40 outputs the compensating current ICP having a current value set by the setting data CTP [6:0]. For example, the current compensating circuit 30 is formed of a decoder for decoding the setting data CTM [6:0], a switch circuit controlled by the decoder, and a plurality of current sources. The switch circuit includes a plurality of switches for controlling whether to flow the output current of each current source to the input node NIA of the inverting amplifier circuit 20. Each of the plurality of switches (for example, transistors) is turned on or off to determine the current value of the compensating current ICM. The decoder decodes the setting data CTM [6:0] into a control signal for setting a current value corresponding to the setting data CTM [6:0]. The control signal is used to control the plurality of switches of the switch circuit to be turned on or off, so that the compensating current ICM having a current value corresponding to the setting data CTM [6:0] is output. Similarly, the current compensating circuit 40 is formed of a decoder for decoding the setting data CTP [6:0], a switch circuit controlled by the decoder, and a plurality of current sources.

Figure 5:
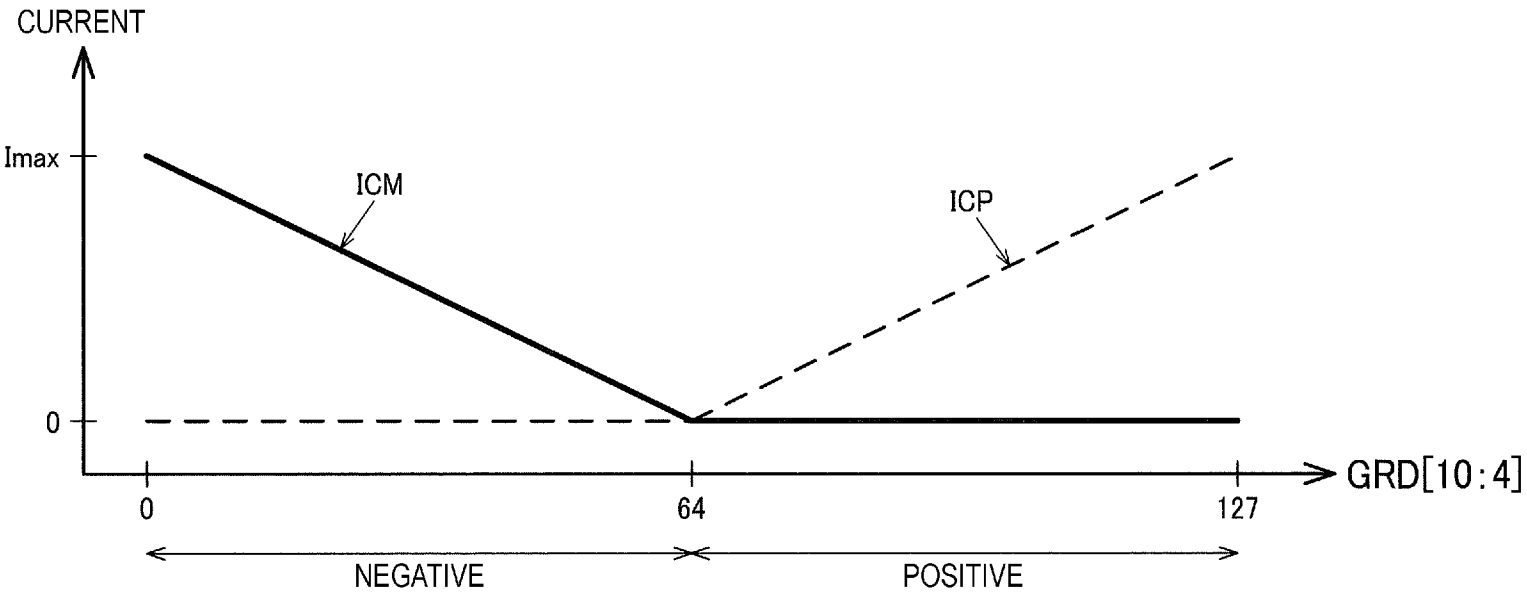
FIG. 5 is a diagram for describing an operation of the display driver of the second configuration example.

FIG. 5 is a diagram for describing an operation of the display driver 100 of the exemplary embodiment. In FIG. 5, the gradation value of the upper-bit data GRD [10:4] is represented by decimal numbers. In addition, a case where the gain of the inverting amplifier circuit 20 is −1 will be described as an example.

As illustrated in FIG. 5, in the negative gradations, the current compensating circuit 30 causes the compensating current ICM to flow from the node NVH of the high electric potential side-power supply voltage to the input node NIA of the inverting amplifier circuit 20. In the negative gradations, VQ<VC<VDA, and a current flows from the input node NIA to the output node NQ of the inverting amplifier circuit 20, so that at least a part of (the whole or a part of) the current is supplied from the current compensating circuit 30 (absorbed by the current compensating circuit 30). For example, in a case where GRD [10:4]=0, ICM=Imax, and ICM varies (decreases) linearly with respect to a gradation value at GRD [10:4]<64. In a case where GRD [10:4]≥64, ICM=0. Imax is a maximum value of the compensating current. For example, Imax=|(VMmax−VPmax)/(r1+r2)| or Imax=|(VC−VPmax)/r1|.

In the positive gradations, the current compensating circuit 40 causes the compensating current ICP to flow from the input node NIA of the inverting amplifier circuit 20 to the node NVL of the low electric potential side-power supply voltage. In the negative gradations, VQ VC VDA, and a current flows from the output node NQ to the input node NIA of the inverting amplifier circuit 20, so that at least a part of (the whole or a part of) the current is absorbed by the current compensating circuit 40. For example, in a case where GRD [10:4]≤64, ICP=0, and ICP varies (increases) linearly with respect to a gradation value at GRD [10:4]≥64. In a case where GRD [10:4]=127, ICP=Imax.

According to the above exemplary embodiment, the current compensating circuit 30 causes the compensating current ICM to flow from the node NVH of the high electric potential side-power supply voltage to the input node NIA of the inverting amplifier circuit 20, and causes the compensating current ICP to flow from the input node NIA of the inverting amplifier circuit 20 to the node NVL of the low electric potential side-power supply voltage. Thus, the current flowing between the input node NIA of the inverting amplifier circuit 20 and the ladder resistance circuit 50 through the D/A converter circuit 10 can be compensated. Accordingly, an error in the gradation voltage VDA output from the D/A converter circuit 10 can be reduced (or canceled) while adopting an inverting amplifier circuit 20 including the resistors R1 and R2 provided as a feedback circuit between the input node NIA and the output node NQ.

3. Third Configuration Example of Display Driver

Figure 6:
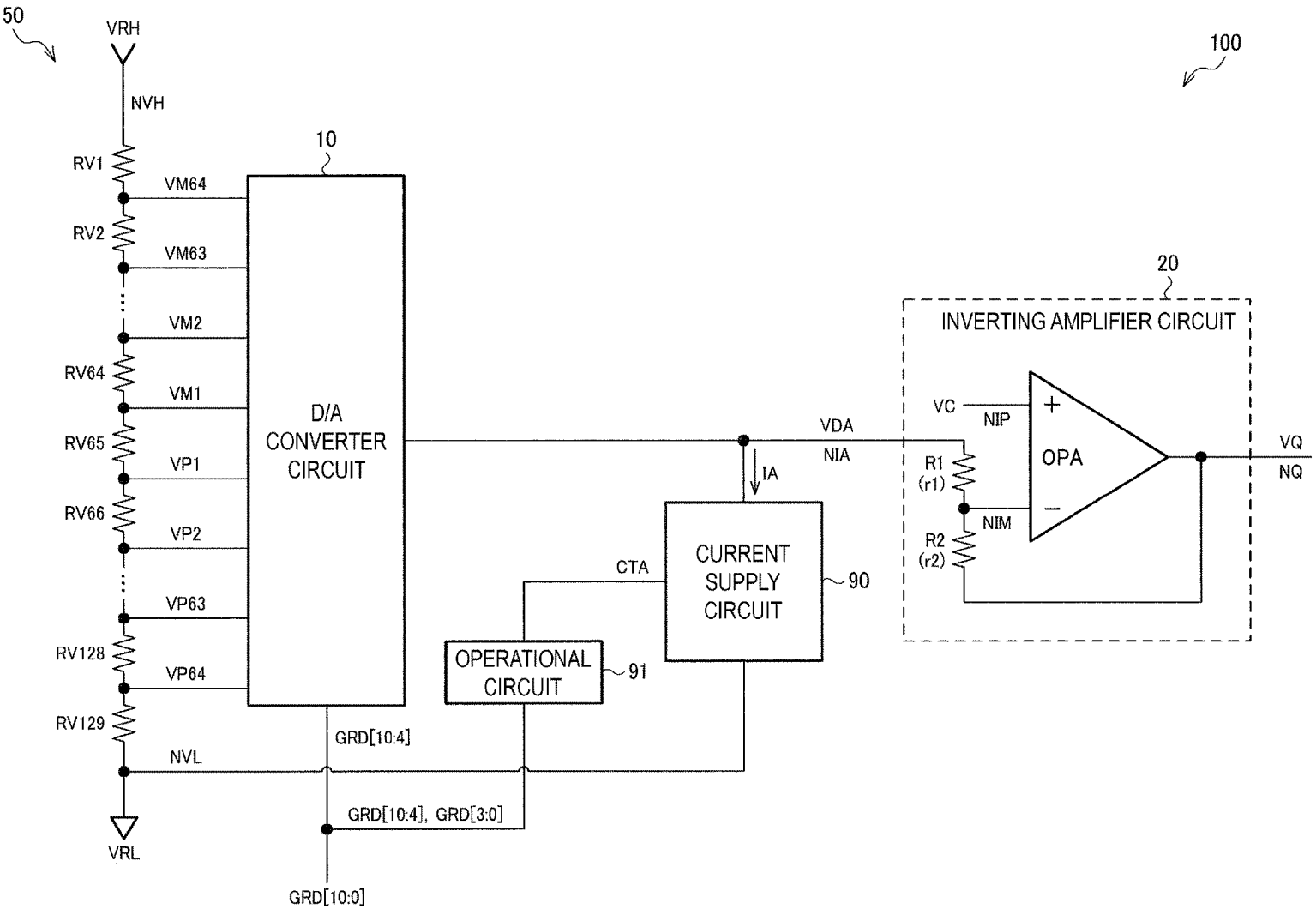
FIG. 6 is a third configuration example of a display driver of the exemplary embodiment.

FIG. 6 is a third configuration example of the display driver 100 of the exemplary embodiment. The display driver 100 includes a D/A converter circuit 10, an inverting amplifier circuit 20, and a current supply circuit 90. The display driver 100 may further include a ladder resistance circuit 50 and an operational circuit 91. Note that the components that are the same as the components described above are referenced using like numbers, and no descriptions for such components are provided below. Here, the invention is not limited to the configuration in FIG. 6, and various modifications can be achieved by, for example, omitting a part of the components or adding another component. For example, the display driver 100 in FIG. 6 may further include the current compensating circuits 30 and 40, and the operational circuit 60 in FIG. 4.

In this configuration example, a voltage VC is input to the non-inverting input terminal of the operational amplifier OPA of the inverting amplifier circuit 20. The voltage VC, which is a reference voltage of the inverting amplification, is a fixed voltage (given voltage). For example, VC=VP1.

The current supply circuit 90 supplies a current IA corresponding to the lower-bit data GRD [3:0] of the display data to the input node NIA of the inverting amplifier circuit 20. The current supply circuit 90, which is provided between the input node NIA of the inverting amplifier circuit 20 and the node NVL of the low electric potential side-power supply voltage, causes the current IA to flow from the input node NIA to the node NVL. The current IA flows in the ladder resistance circuit 50 (node of the voltage selected by the D/A converter circuit 10) through the D/A converter circuit 10. This allows the gradation voltage VDA to be decreased, enabling the output voltage VQ of the inverting amplifier circuit 20 to be increased. The current IA increases and the the gradation voltage VDA decreases as the gradation value of the lower-bit data GRD [3:0] increases. Thus, the output voltage VQ of the inverting amplifier circuit 20 increases as the gradation value of the lower-bit data GRD [3:0] increases.

The operational circuit 91 calculates the setting data CTA for setting the current value of the current IA based on the upper-bit data GRD [10:4] and the lower-bit data GRD [3:0]. The current value indicated by the setting data CTA is a current value that causes the gradation voltage VDA to be varied by the voltage corresponding to the lower-bit data GRD [3:0]. As described below, the current value of the current IA also depends on the upper-bit data GRD [10:4]. The operational circuit 91 is realized by a logic circuit. Note that the operational circuit 91 may also be realized by a digital signal processor (DSP) for executing a plurality of processes of digital signal processing in the time-division manner. In this case, operational processing is executed in the time-division manner together with another digital signal processing.

The current supply circuit 90 outputs the current IA having a current value set by the setting data CTA. For example, the current supply circuit 90 is formed of a decoder for decoding the setting data CTA, a switch circuit controlled by the decoder, and a plurality of current sources. The switch circuit includes a plurality of switches for controlling whether to flow the output current of each current source to the input node NIA of the inverting amplifier circuit 20. Each of the plurality of switches (for example, transistors) is turned on or off to determine the current value of the current IA. The decoder decodes the setting data CTA into a control signal for setting a current value corresponding to the setting data CTA. The control signal is used to control the plurality of switches of the switch circuit to be turned on or off, so that the current IA having a current value corresponding to the setting data CTA is output.

Figure 7:
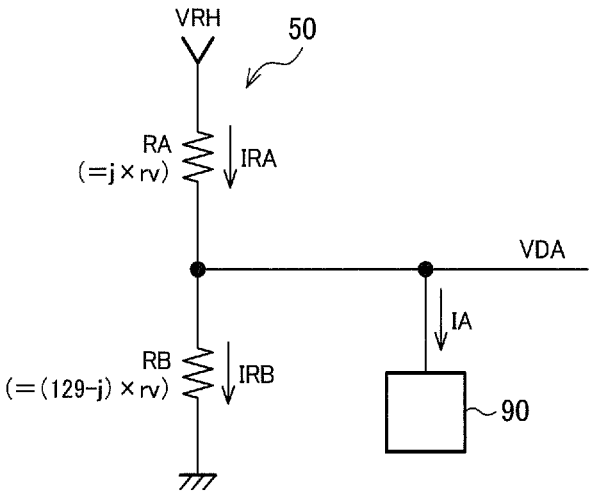
FIG. 7 is a model diagram for describing a current output from a current supply circuit.

FIG. 7 is a model diagram for describing the current IA output from the current supply circuit 90. The upper-bit data are assumed to be GRD [10:4]=j−1 (j is an integer from 1 to 128). In addition, the resistance value of the resistances forming the ladder resistance circuit 50 is assumed such that rv=RV1=RV2= . . . =RV129. Note that the resistance values of RV1 and RV129 may be different from rv. Also note that, to simplify the calculation, it is assumed that VRL=0 V.

At this time, the voltage of the node between a resistor RA having a resistance value j×rv and a resistor RB having a resistance value (129−j)×rv is output as the gradation voltage VDA. IRA=IRB+IA, VRH−VDA=(j×rv)×IRA, and VDA={(129−j)×rv}×IRB provided that IRA is a current flowing through the resistor RA and that IRB is a current flowing through the resistor RB. From the above simultaneous equations, IA={1/(j×rv)}×{VRH−VDA×129/(129−j)} is obtained. From this equation, the current IA that causes the gradation voltage VDA to be varied by ΔV=VM1−VP1 for one gradation is ΔV×129/{j (129−j)×rv}. The current supply circuit 90 supplies, as the current IA, the current that corresponds to the lower-bit data GRD [3:0] among currents obtained by dividing ΔV×129/{j (129−j)×rv} by $2^4$. That is, $IA=(i/2^4)\times\Delta V\times 129/\{j\ (129-j)\times rv\}$. The operational circuit 91 calculates the current IA from the upper-bit data GRD [10:4]=j and the lower-bit data GRD [3:0]=i to generate the setting data CTA.

According to the above exemplary embodiment, the current supply circuit 90 supplies the current IA corresponding to the lower-bit data GRD [3:0] of the display data to the input node NIA of the inverting amplifier circuit 20.

The current IA is supplied to the input node NIA of the inverting amplifier circuit 20, causing the voltage (VDA) of the input node NIA to be varied, so that the output voltage VQ of the inverting amplifier circuit 20 is varied. In other words, the current IA corresponding to the lower-bit data GRD [3:0] is supplied to the input node NIA, and this enables the inverting amplifier circuit 20 to output the output voltage VQ corresponding to the lower-bit data GRD [3:0]. This allows each gradation of the upper-bit data GRD [10:4] to be further divided with the lower-bit data GRD [3:0], enabling the number of gradations to be increased.

In the exemplary embodiment, the ladder resistance circuit 50 generates a plurality of voltages VM64 to VM1 and VP1 to VP64. The D/A converter circuit 10 selects the voltage corresponding to the upper-bit data GRD [10:4] from the plurality of voltages VM64 to VM1 and VP1 to VP64 as the gradation voltage VDA and outputs the gradation voltage VDA to the input node NIA of the inverting amplifier circuit 20. The current supply circuit 90 supplies the current IA to the ladder resistance circuit 50 through the D/A converter circuit 10.

The current IA is supplied to the ladder resistance circuit 50, causing the current flowing through the resistance forming the ladder resistance circuit 50 to be varied, then, the gradation voltage VDA is varied. As described in FIG. 7, since the relationship between the amount of variation in the gradation voltage VDA and the current value of the current IA is apparent, the voltage difference of the gradation voltage VDA per one gradation of the upper-bit data GRD [10:4] can be divided by $2^4$ with the lower-bit data GRD [3:0].

4. Fourth Configuration Example of Display Driver

Figure 8:
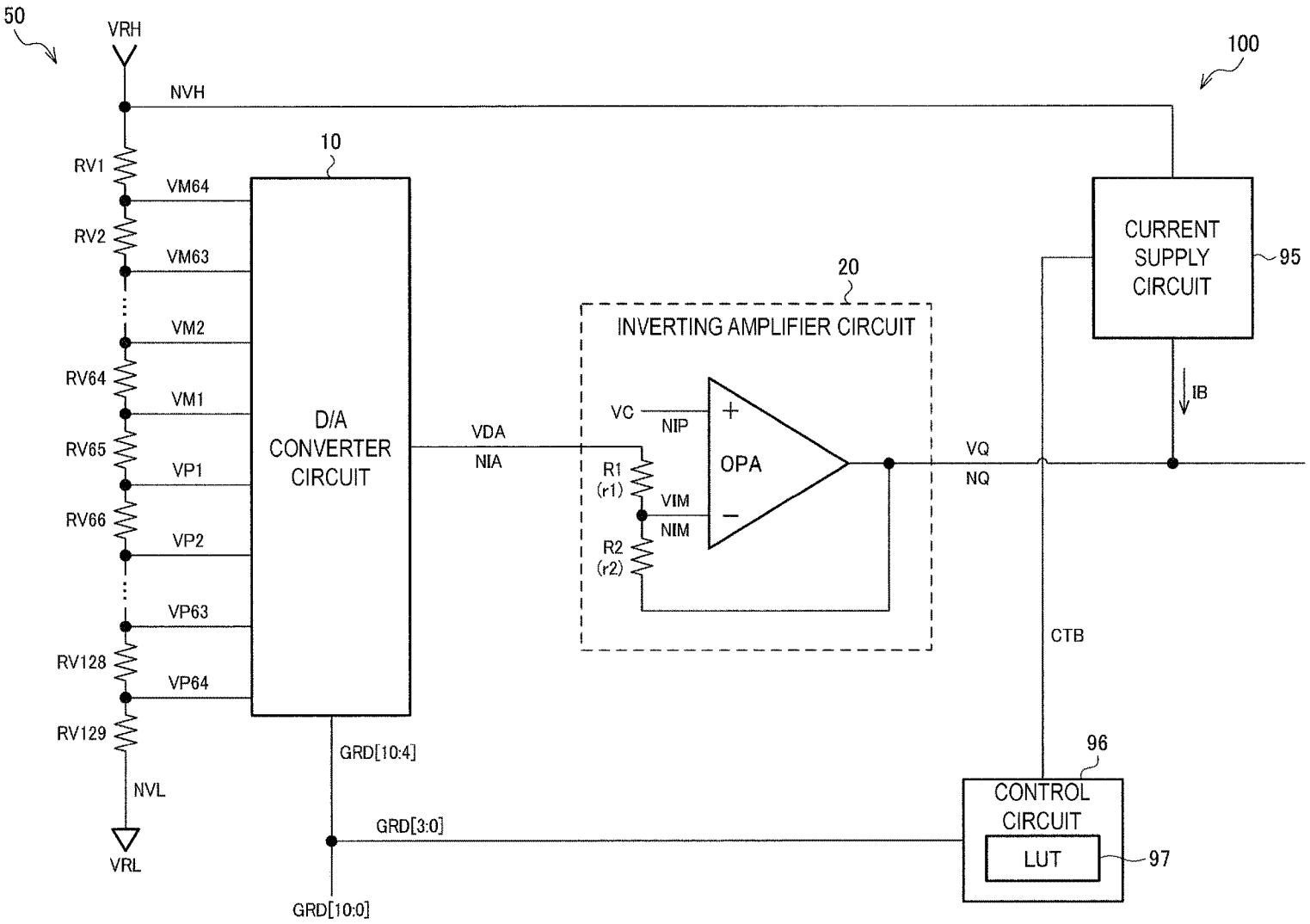
FIG. 8 is a fourth configuration example of a display driver of the exemplary embodiment.

FIG. 8 is a fourth configuration example of the display driver 100 of the exemplary embodiment. The display driver 100 includes a D/A converter circuit 10, an inverting amplifier circuit 20, and a current supply circuit 95. The display driver 100 may further include a ladder resistance circuit 50 and a control circuit 96. Note that the components that are the same as the components described above are referenced using like numbers, and no descriptions for such components are provided below. Here, the exemplary embodiment is not limited to the configuration in FIG. 8, and various modifications can be achieved by, for example, omitting a part of the components or adding another component. For example, the display driver 100 in FIG. 8 may further include the current compensating circuits 30 and 40, and the operational circuit 60 in FIG. 4.

A current supply circuit 95 supplies a current IB corresponding to the lower-bit data GRD [3:0] of the display data to the output node NQ of the inverting amplifier circuit 20. The current supply circuit 95, which is provided between the output node NQ of the inverting amplifier circuit 20 and the node NVH of the high electric potential side-power supply voltage, causes the current IB to flow from the node NVH to the output node NQ. The current IB flows to the output terminal of the operational amplifier OPA of the inverting amplifier circuit 20. This allows a voltage VIM of the inverting input terminal of the operational amplifier OPA and the output voltage VQ of the inverting amplifier circuit 20 to be increased. The current IB and the voltage VIM of the inverting input terminal increase as the gradation value of the lower-bit data GRD [3:0] increases. Thus, the output voltage VQ of the inverting amplifier circuit 20 increases as the gradation value of the lower-bit data GRD [3:0] increases.

The control circuit 96 calculates a setting data CTB for setting the current value of the current IB based on the lower-bit data GRD [3:0]. The current value indicated by the setting data CTB is a current value that causes the output voltage VQ to be varied by a voltage corresponding to the lower-bit data GRD [3:0]. The current IB causes the voltage VIM of the inverting input terminal of the operational amplifier OPA to be varied, which is equivalent to causing the voltage (reference voltage) of the non-inverting input terminal to be varied. That is, similarly to the reference voltage Vref described in the first configuration example, the voltage VIM of the inverting input terminal may be controlled. The control circuit 96 controls the current IB to generate such a voltage VIM. For example, the control circuit 96 refers to a look-up table 97 (LUT) in which GRD [3:0] and the current value are associated with each other and outputs the setting data CTB corresponding to GRD [3:0]. The operational circuit 60 is realized by a logic circuit. The look-up table 97 is stored in, for example, a register or a memory (for example, RAM or a nonvolatile memory).

The current supply circuit 95 outputs the current IB having a current value set by the setting data CTB. For example, the current supply circuit 95 is formed of a decoder for decoding the setting data CTB, a switch circuit controlled by the decoder, and a plurality of current sources. The switch circuit includes a plurality of switches for controlling whether to flow the output current of each current source to the output node NQ of the inverting amplifier circuit 20. Each switch of the plurality of switches (for example, transistors) is turned on or off to determine the current value of the current IB. The decoder decodes the setting data CTB into a control signal for setting a current value corresponding to the setting data CTB. The control signal is used to control the plurality of switches of the switch circuit to be turned on or off, then, the current IB having a current value corresponding to the setting data CTB is output.

Figure 9:
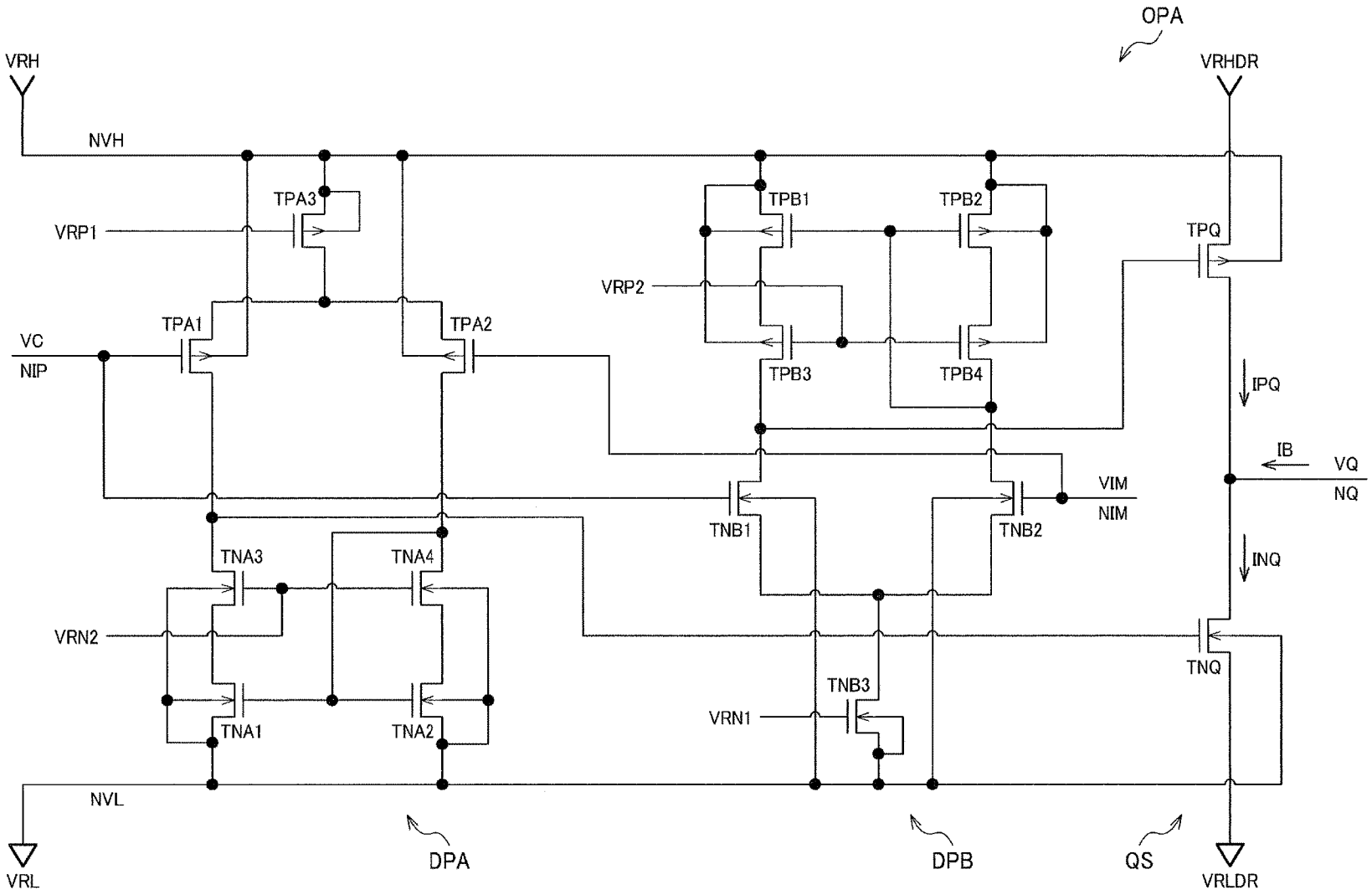
FIG. 9 is a detailed configuration example of an operational amplifier.

With reference to FIG. 9, the voltage VIM of the inverting input terminal of the operational amplifier OPA varied in accordance with the current IB is described. FIG. 9 is a detailed configuration example of the operational amplifier OPA.

The operational amplifier OPA includes a differential pair unit DPA, a differential pair unit DPB, and an output unit QS. The differential pair unit DPA includes P-type transistors TPA1 to TPA3 and N-type transistors TNA1 to TNA4. TPA1 and TPA2 form a differential pair, the gate of TPA1 is coupled to the non-inverting input terminal (node NIP), and the gate of TPA2 is coupled to the inverting input terminal (node NIM). The differential pair unit DPB includes P-type transistors TPB1 to TPB4 and N-type transistors TNB1 to TNB3. TNB1 and TNB2 form a differential pair, the gate of TNB1 is coupled to the non-inverting input terminal (NIA), and the gate of TNB2 is coupled to the inverting input terminal (NIM). The output unit QS includes a P-type transistor TPQ and an N-type transistor TNQ. The drain of TNB1 of the differential pair unit DPB is coupled to the gate of TPQ. The drain of TPA1 of the differential pair unit DPA is coupled to the gate of TNQ.

Currents flowing through the transistors TPQ and TNQ of the output unit QS are defined as IPQ and INQ. In a case where IB=0 and there is no variation in the output voltage VQ, IPQ=INQ. Herein, supposing that there is no offset between the input terminals of the operational amplifier OPA, VIM=VC. On the other hand, in a case where IB>0 and there is no variation in the output voltage VQ, IPQ+IB=INQ. In other words, a current IPQ of the transistor TPQ decreases or a current INQ of the transistor TNQ increases in comparison with a case where IB=0. Although the input voltage of the differential pair is varied in accordance with these variations, the voltage VIM of the inverting input terminal (NIM) input to the gates of the transistors TPA2 and TNB2 is varied because the voltage VC of the non-inverting input terminal (NIP) is fixed. Since the current IPQ is decreased or the current INQ is increased, the voltage VIM is varied so as to be increased. When the increment is ΔVIM, VIM=VC+ΔVIM. Then, the ΔVIM causes the output voltage VQ of the inverting amplifier circuit 20 to be increased. When the gain between ΔVIM and IB is GVI, ΔVIM=IB/GVI. Thus, the current IB can be associated with ΔVIM (i.e., current IB and output voltage VQ).

For example, with reference to FIG. 3 described in the first configuration example, the voltage VIM is varied in the configuration example, instead of the reference voltage Vref in FIG. 3. In other words, $VIM=VC+i\times\{(1/2)\times\Delta V/2^4\}$ and the output voltage of the non-inverting circuit is represented by $VQ=VM1+i\times(\Delta V/2^4)$ provided that the lower-bit data GRD [3:0]=i. For example, the current IB causing such a variation in voltage may be calculated using circuit simulation to prepare a look-up table, which may be stored as the look-up table 97 in FIG. 8.

According to the above exemplary embodiment, the current supply circuit 95 supplies the current IB corresponding to the lower-bit data GRD [3:0] of the display data to the output node NQ of the inverting amplifier circuit 20.

The current IB is supplied to the output node NQ of the inverting amplifier circuit 20, causing the voltage VIM of the inverting input terminal of the operational amplifier OPA to be varied, then, the output voltage VQ of the inverting amplifier circuit 20 is varied. In other words, the current IB corresponding to the lower-bit data GRD [3:0] is supplied to the output node NQ, enabling the inverting amplifier circuit 20 to output the output voltage VQ corresponding to the lower-bit data GRD [3:0]. This allows each gradation of the upper-bit data GRD [10:4] to be further divided with the lower-bit data GRD [3:0], enabling the number of gradations to be increased.

In the exemplary embodiment, the inverting amplifier circuit 20 includes an operational amplifier OPA, the output terminal of which is coupled to the output node NQ of the inverting amplifier circuit 20. The current supply circuit 95 supplies the current IB to the output terminal of the operational amplifier OPA.

The current IB flows to the output terminal of the operational amplifier OPA, causing a current to flow through the output unit QS of the operational amplifier OPA. Thus, the voltage VIM of the inverting input terminal is varied. This allows the output voltage VQ of the inverting amplifier circuit 20 to be controlled by the current IB, enabling the voltage difference per one gradation of the upper-bit data GRD [10:4] to be divided by $2^4$ with the lower-bit data GRD [3:0].

5. Fifth Configuration Example of Display Driver

Figure 10:
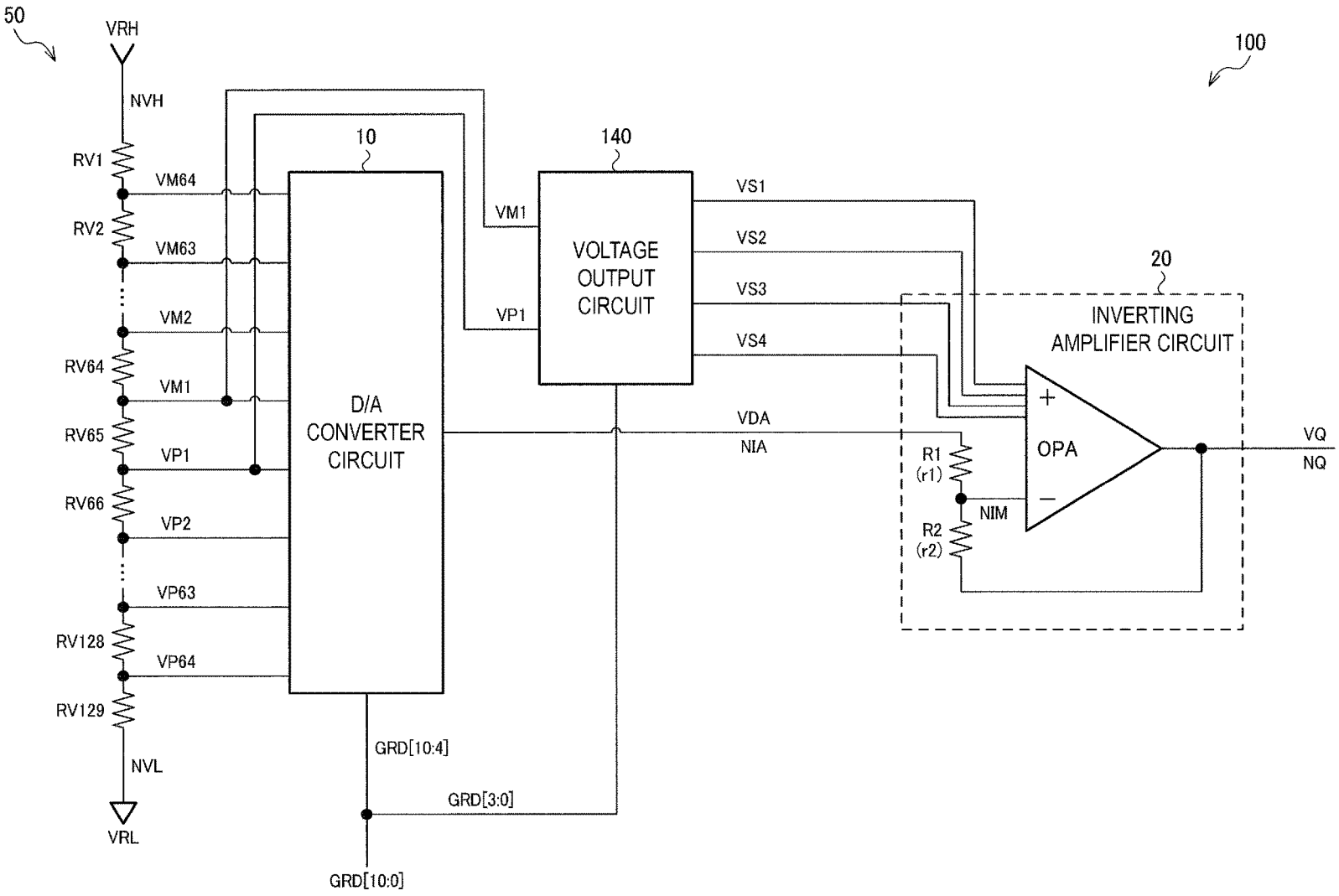
FIG. 10 is a fifth configuration example of a display driver of the exemplary embodiment.

FIG. 10 is a fifth configuration example of the display driver 100 of the exemplary embodiment. The display driver 100 includes a D/A converter circuit 10, an inverting amplifier circuit 20, and a voltage output circuit 140. The display driver 100 may further include a ladder resistance circuit 50. Note that the components that are the same as the components described above are referenced using like numbers, and no descriptions for such components are provided below. Here, the exemplary embodiment is not limited to the configuration in FIG. 10, and various modifications can be achieved by, for example, omitting a part of the components or adding another component. For example, the display driver 100 in FIG. 10 may further include the current compensating circuits 30 and 40, and the operational circuit 60 in FIG. 4.

The lower-bit data GRD [3:0] is input to the voltage output circuit 140, and the voltage output circuit 140 outputs output voltages VS1 to VS4 based on GRD [3:0]. It is noted that the voltage output circuit 140 may output, not limited to the above, first to the p-th output voltages (p is an integer of 2 or greater). Specifically, the voltage output circuit 140 outputs a first reference voltage as the output voltage VS1 in a case where GRD [0]=0 and outputs a second reference voltage as the output voltage VS1 in a case where GRD [0]=1. Similarly, the voltage output circuit 140 outputs a first reference voltage as the output voltages VS2, VS3, and VS4 in a case where GRD [1]=0, GRD [2]=0, and GRD [3]=0, respectively. The voltage output circuit 140 outputs a second reference voltage as the output voltages VS2, VS3, and VS4 in a case where GRD [1]=1, GRD [2]=1, and GRD [3]=1, respectively. For example, the voltage output circuit 140 generates the first and second reference voltages based on the voltages VP1 (VC) and VP2 from the ladder resistance circuit 50. The output voltages VS1 to VS4 are input to the transistor corresponding to the non-inverting input terminal among the transistors forming the differential pair of the operational amplifier OPA. The output voltages VS1 to VS4 are varied in accordance with GRD [3:0] so as to be equivalent to a variation in the reference voltage of the inverting amplifier circuit 20, then, the output voltage VQ of the inverting amplifier circuit 20 is varied.

Figure 11:
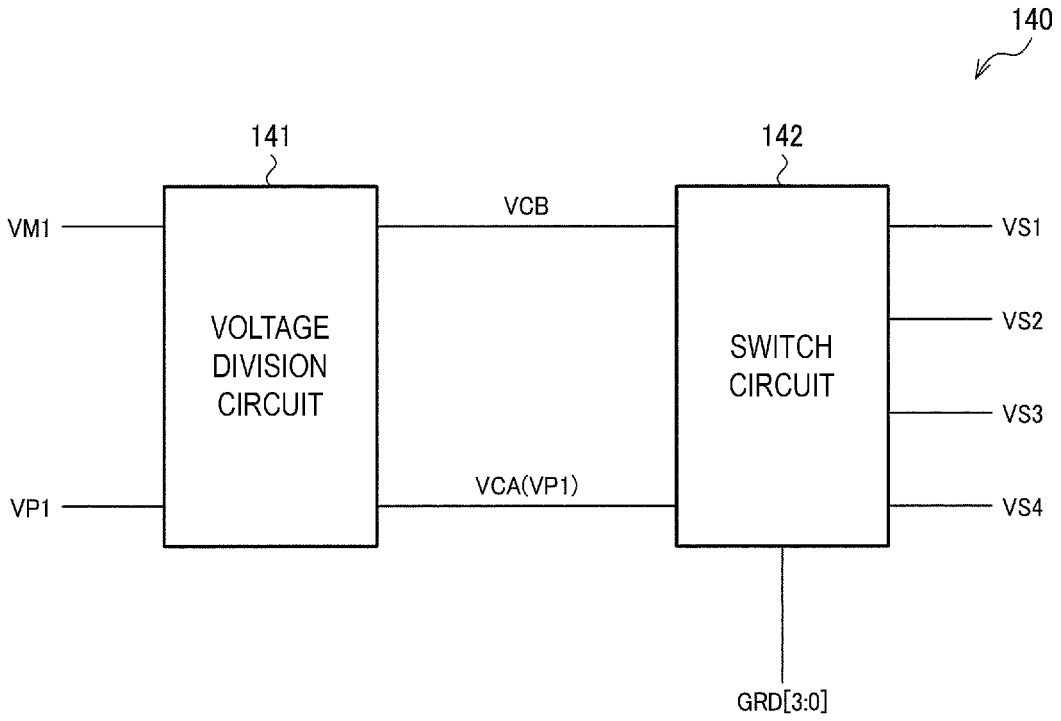
FIG. 11 is a detailed configuration example of a voltage output circuit.

FIG. 11 is a detailed configuration example of the voltage output circuit 140. The voltage output circuit 140 includes a voltage division circuit 141 and a switch circuit 142.

The voltage division circuit 141 outputs a reference voltage VCA (first reference voltage) and a reference voltage VCB (second reference voltage) based on the voltages VP1 and VM1. For example, the voltage division circuit 141 outputs the voltage VP1 as the reference voltage VCA and outputs a voltage obtained by dividing a voltage between the voltages VP1 and VM1 as the reference voltage VCB. For example, the voltage division circuit 141 is a resistance dividing circuit. $VCB=VCA+\Delta V\times|G|/(1+|G|)$ provided that G is a gain of the inverting amplifier circuit 20 and $\Delta V=VM1-VP1$.

The switch circuit 142 includes a switch for selecting the reference voltage VCA or the reference voltage VCB as the output voltage VS1 based on GRD [0] and a switch for selecting the reference voltage VCA or reference voltage VCB as the output voltage VS2 based on GRD [1]. The switch circuit 142 further includes a switch for selecting the reference voltage VCA or the reference voltage VCB as the output voltage VS3 based on GRD [2] and a switch for selecting the reference voltage VCA or the reference voltage VCB as the output voltage VS4 based on GRD [3].

Figure 12:
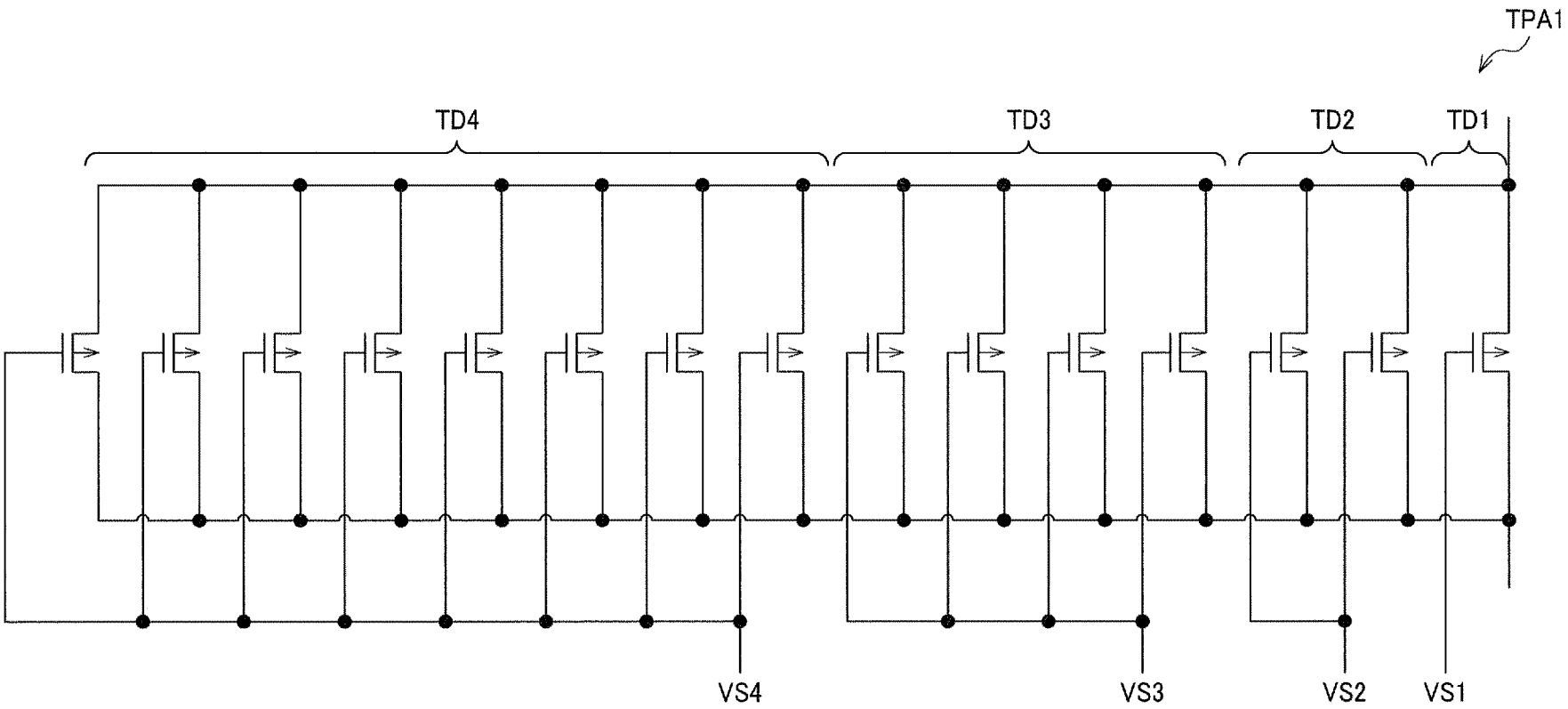
FIG. 12 is a configuration example of a transistor corresponding to a non-inverting input terminal among transistors forming a differential pair of an operational amplifier.

FIG. 12 is a configuration example of the transistor TPA1 corresponding to a non-inverting input terminal among the transistors forming the differential pair of the operational amplifier OPA. Note that, in the configuration example, the configuration of the operational amplifier OPA is basically the same as the configuration in FIG. 9 except for the configuration of the transistors TPA1 and TNB1. FIG. 12 depicts the TPA1 having the same configuration as the TNB1.

A transistor TPA is formed of transistors TD1 to TD4 that are coupled in parallel with each other. The transistors TD1 to TD4 differ in size from each other, the sizes of which are weighted by a power of 2. For example, the transistor TD1 is formed of $2^0$ transistors, the transistor TD2 is formed of $2^1$ transistors, the transistor TD3 is formed of $2^2$ transistors, and the transistor TD4 is formed of $2^3$ transistors. The output voltage VS1 is input to the gate of the transistor TD1. Similarly, output voltages VS2, VS3, and VS4 are input to the gates of the transistors TD2, TD3, and TD4, respectively.

Such a configuration allows the voltage of the inverting input terminal of the operational amplifier OPA to be represented by $VIM=VCA+i\times\{\Delta V\times|G|/(1+|G|)/2^4\}$. Here, i=GRD [3:0]. This is equivalent to the fact that the reference voltage of the inverting amplifier circuit 20 is substantially $VCA+i\times\{\Delta V\times|G|/(1+|G|)/2^4\}$. For example, in a case where the upper-bit data GRD [10:4]=65, $VQ=VM1+i\times(\Delta V/2^4)$ for the output voltage of the inverting amplifier circuit 20, as in the first configuration example.

According to the above exemplary embodiment, the operational amplifier OPA includes transistors TD1 to TD4 (first to p-th transistors; p is an integer of 2 or greater) that are coupled in parallel with each other as transistors of a differential pair corresponding to a non-inverting input terminal. The voltage output circuit 140 selects, based on the lower-bit data GRD [3:0], either the reference voltage VCA or the reference voltage VCB as each of the output voltages VS1 to VS4 (first to p-th output voltages). The reference voltage VCB is a voltage that differs from the reference voltage VCA. The voltage output circuit 140 outputs the output voltages VS1 to VS4 to the gates of the transistors TD1 to TD4.

This allows each of the output voltages VS1 to VS4 input to the transistors TD1 to TD4 corresponding to the non-inverting input terminal of the operational amplifier OPA to be selected, based on the lower-bit data GRD [3:0], from the reference voltages VCA and VCB. Thus, the voltage VIM of the inverting input terminal of the operational amplifier OPA is varied, enabling the inverting amplifier circuit 20 to output the output voltage VQ corresponding to the lower-bit data GRD [3:0]. Accordingly, each gradation of the upper-bit data GRD [10:4] is further divided with the lower-bit data GRD [3:0], enabling the number of gradations to be increased.

In the exemplary embodiment, the voltage difference between the reference voltage VCA and the reference voltage VCB is represented by $\Delta V\times|G|/(1+|G|)$.

This allows for $VIM=VCA+i\times\{\Delta V\times|G|/(1+|G|)/2^4\}$ for GRD [3:0]=i, and the output voltage of the inverting amplifier circuit 20 is represented by $VQ=VM1+i\times(\Delta V/2^4)$, for example. That is, the voltage difference per one gradation of the upper-bit data GRD [10:4] can be divided by $2^4$ with the lower-bit data GRD [3:0].

6. Electro-Optical Apparatus

Figure 13:
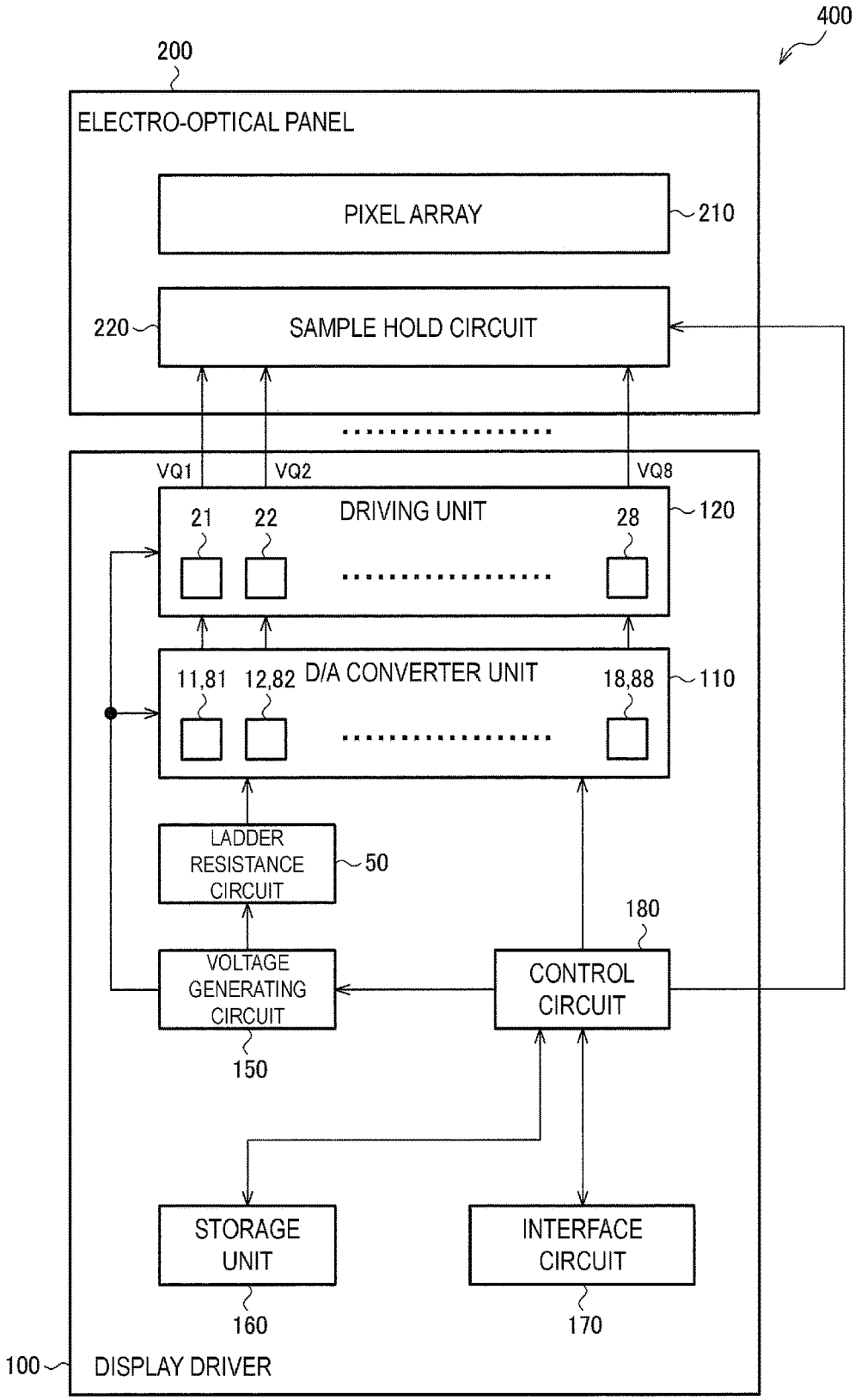
FIG. 13 is a configuration example of an electro-optical device.

FIG. 13 is a configuration example of an electro-optical device 400 including the display driver 100 of the exemplary embodiment. The electro-optical device 400 (display device) includes the display driver 100 and an electro-optical panel 200 (display panel). Note that a case where the display driver 100 executes phase development driving will be described as an example below. However, an application target of the invention is not limited to this, and the invention is also applicable to, for example, multiplex driving (demultiplex driving) and the like.

The electro-optical panel 200 includes a pixel array 210 and a sample hold circuit 220 (switch circuit). The electro-optical panel 200 is, for example, a liquid crystal display panel, an electro luminescence (EL) display panel, and the like.

The pixel array 210 includes a plurality of pixels disposed in an array (matrix). In the phase development driving, eight source lines (k source lines in a broad sense; k is an integer of 2 or greater) of the pixel array 210 are successively driven. Specifically, the sample hold circuit 220 is a circuit that samples and holds data voltages VQ1 to VQ8 from the display driver 100 to source lines of the pixel array 210. More specifically, the data voltages VQ1 to VQ8 are respectively input to first to 8-th data lines of the electro-optical panel 200. It is assumed that the pixel array 210 includes first to 640-th source lines, for example. The sample hold circuit 220 couples the first to 8-th data lines to the first to 8-th source lines in a first period and couples the first to 8-th data lines to the 9-th to 16-th source lines in a next second period. The same applies to the following, and then the sample hold circuit 220 couples the first to 8-th data lines to the 633-th to 640-th source lines in the 80-th period. Such an operation is executed in each of the horizontal scanning periods.

The display driver 100 includes the ladder resistance circuit 50, a digital-to-analog (D/A) converter unit 110 (D/A converter circuit), a driving unit 120 (drive circuit), a voltage generating circuit 150, a storage unit 160 (memory), an interface circuit 170, and a control circuit 180 (controller).

Figure 14:
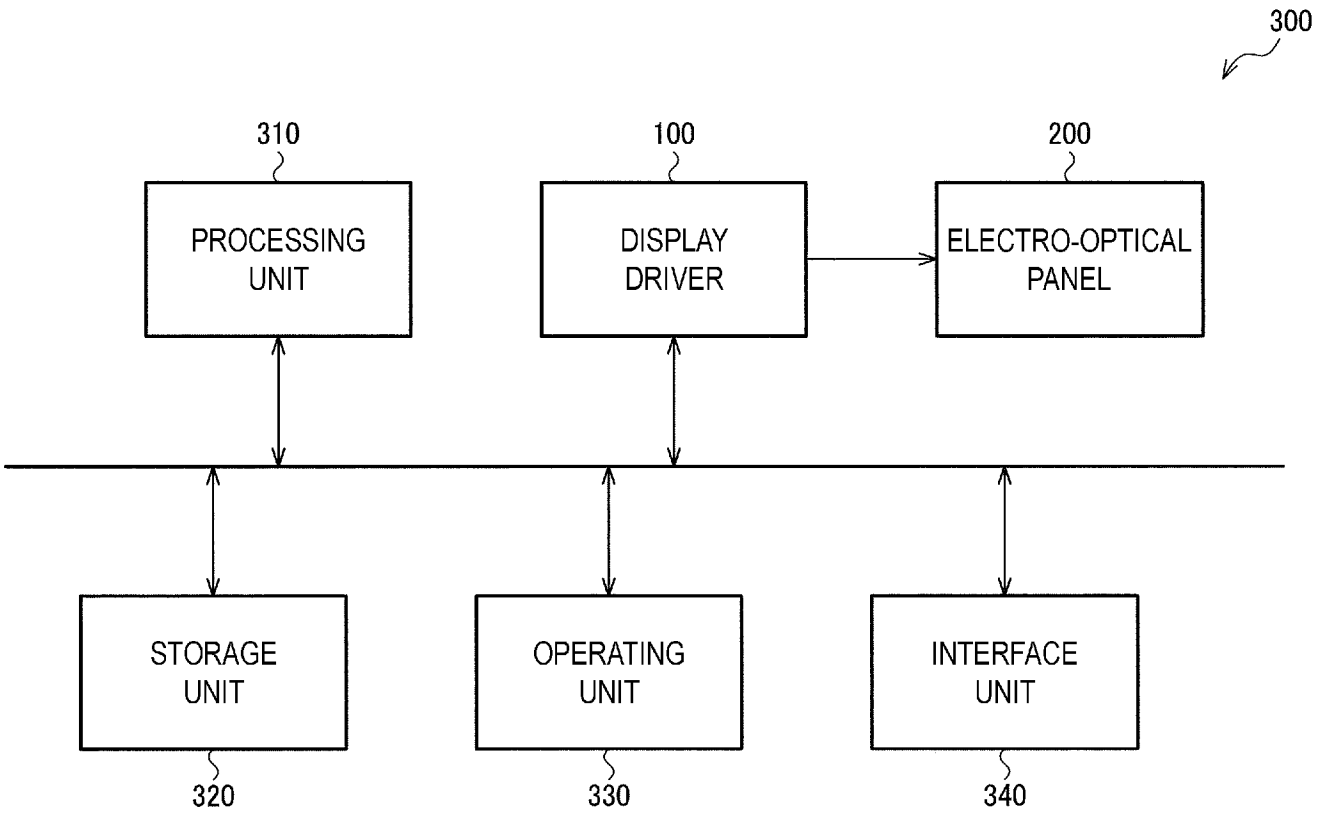
FIG. 14 is a configuration example of an electronic apparatus.

The interface circuit 170 communicates between the display driver 100 and an external processing device (for example, the processing unit 310 in FIG. 14). For example, a clock signal, a timing control signal, and display data are input from the external processing device to the control circuit 180 through the interface circuit 170.

The control circuit 180 controls each of the units of the display driver 100 and each of the units of the electro-optical panel 200, based on the clock signal, the timing control signal, and the display data input through the interface circuit 170. For example, the control circuit 180 controls display timing such as selection of a horizontal scanning line of the pixel array 210, vertical synchronizing control of the pixel array 210, and control of phase development driving (the above-mentioned first to 80-th periods), and then controls the D/A converter unit 110 and the sample hold circuit 220 according to the display timing.

The voltage generating circuit 150 generates various voltages and outputs the voltage to the driving unit 120 and the D/A converter unit 110. For example, the voltage generating circuit 150 generates a power source of the D/A converter unit 110 and the driving unit 120. The voltage generating circuit 150 is formed of, for example, a regulator and the like.

The D/A converter unit 110 includes D/A converter circuits 11 to 18 and 81 to 88. Each of the D/A converter circuits 11 to 18 has the same configuration as the configuration of the D/A converter circuit 10 described with reference to FIG. 1. Each of the D/A converter circuits 81 to 88 has the same configuration as the configuration of the D/A converter circuit 80 described with reference to FIG. 1. The driving unit 120 includes inverting amplifier circuits 21 to 28 (drive circuits). Each of the inverting amplifier circuits 21 to 28 has the same configuration as the configuration of the inverting amplifier circuit 20 described with reference to FIG. 1 and the like. The D/A converter circuits 11 to 18 convert the upper-bit data of the display data from the control circuit 180 from digital to analog and respectively output the voltage converted from digital to analog to the inverting amplifier circuits 21 to 28. The D/A converter circuits 81 to 88 convert the lower-bit data of the display data from digital to analog and respectively output the voltage converted from digital to analog to the inverting amplifier circuits 21 to 28. The inverting amplifier circuits 21 to 28 invert and amplify the voltage from the D/A converter circuits 11 to 18 with reference to the reference voltages from the D/A converter circuits 81 to 88, and then respectively output the data voltages VQ1 to VQ8 to the electro-optical panel 200.

The storage unit 160 stores various types of data (for example, setting data) used for controlling the display driver 100. For example, the storage unit 160 is formed of a non-volatile memory or RAM (such as SRAM, DRAM, and the like).

Note that, although the display driver in FIG. 1 is applied to the electro-optical device in the above descriptions, the display drivers in FIGS. 4, 6, 8, and 10 may be applied to the electro-optical device. When the display driver in FIG. 4 is applied, current compensating circuits 30 and 40 are provided corresponding to each of the 8 data voltage outputs, and for example, the control circuit 180 includes the operational circuit 60. When the display driver in FIG. 6 is applied, a current supply circuit 90 is provided corresponding to each of the 8 data voltage outputs, and for example, the control circuit 180 includes the operational circuit 91. When the display driver in FIG. 8 is applied, the current supply circuit 95 is provided corresponding to each of the 8 data voltage outputs, and for example, the control circuit 180 includes the control circuit 96. When the display driver in FIG. 10 is applied, the voltage output circuit 140 is provided corresponding to each of the 8 data voltage outputs.

7. Electronic Apparatus

FIG. 14 is a configuration example of an electronic apparatus 300 including the display driver 100 of the exemplary embodiment. Specific examples of the electronic apparatus 300 may include various electronic apparatuses in which a display device is installed, such as projectors, head-mounted displays, mobile information terminals, vehicle-mounted devices (for example, a meter panel, a car navigation system, and the like), portable game terminals, and information processing devices.

The electronic apparatus 300 includes a processing unit 310 (for example, a processor such as a CPU, a display controller, or an ASIC), a storage unit 320 (for example, a memory, a hard disk, and the like), an operation unit 330 (operation device), an interface unit 340 (interface circuit, interface device), the display driver 100, and the electro-optical panel 200.

The operation unit 330 is a user interface for receiving various operations from a user. For example, the operation unit 330 is a button, a mouse, a keyboard and a touch panel attached to the electro-optical panel 200, and the like. The interface unit 340 is a data interface for inputting and outputting image data and control data. For example, the interface unit 340 is a wired communication interface such as a USB or a wireless communication interface such as a wireless LAN. The storage unit 320 stores data input from the interface unit 340. Alternatively, the storage unit 320 operates as a working memory of the processing unit 310. The processing unit 310 processes display data input from the interface unit 340 or stored in the storage unit 320 and then transfers the display data to the display driver 100. The display driver 100 displays an image on the electro-optical panel 200, based on the display data transferred from the processing unit 310.

For example, in a case where the electronic apparatus 300 is a projector, the electronic apparatus 300 further includes a light source and an optical device (for example, a lens, a prism, a mirror, and the like). In a case where the electro-optical panel 200 is transmissive, the optical device causes light from the light source to be incident on the electro-optical panel 200, and projects the light passing through the electro-optical panel 200 onto a screen (display section). In a case where the electro-optical panel 200 is reflective, the optical device causes light from the light source to be incident on the electro-optical panel 200, and projects the light reflected by the electro-optical panel 200 onto the screen (display section).

Although some exemplary embodiments have been described in detail above, those skilled in the art will understand that many modified examples can be made without substantially departing from the novel matter and effects of the invention. All such modified examples are thus included in the scope of the invention. For example, terms in the descriptions or drawings given even once along with different terms having identical or broader meanings can be replaced with different terms for all parts of the descriptions or drawings. All combinations of the exemplary embodiments and modified examples are also included within the scope of the invention. The configurations, the operations, and the like of the display driver, the electro-optical panel, the electro-optical device, and the electronic apparatus are not limited to those described in the exemplary embodiments, and various modifications can be achieved.

The entire disclosure of Japanese Patent Application No. 2017-220737, filed Nov. 16, 2017 is expressly incorporated by reference herein.

What is claimed is:

1. A display driver comprising:

a first digital-to-analog (D/A) converter circuit configured to convert upper-bit data of display data into a gradation voltage corresponding to the upper-bit data;

a second digital-to-analog (D/A) converter circuit configured to output a reference voltage that is varied in accordance with lower-bit data of the display data;

an inverting amplifier circuit configured to amplify the gradation voltage with reference to the reference voltage and to drive a data line of an electro-optical panel;

a first current compensating circuit provided between an input node of the inverting amplifier circuit and a node of a high electric potential side-power supply voltage, the first current compensating circuit being configured to cause a first compensating current to flow from a node of the high electric potential side-power supply voltage to the input node of the inverting amplifier circuit; and a second current compensating circuit provided between the input node of the inverting amplifier circuit and a node of a low electric potential side-power supply voltage, the second current compensating circuit being configured to cause a second compensating current to flow from the input node of the inverting amplifier circuit to a node of the low electric potential side-power supply voltage, wherein the inverting amplifier circuit includes:

an operational amplifier including a non-inverting input terminal to which the reference voltage is input, a first resistor provided between the input node to which the gradation voltage is input and an inverting input terminal of the operational amplifier, and a second resistor provided between an output terminal of the operational amplifier and the inverting input terminal, and wherein the second D/A converter circuit outputs a voltage corresponding to the lower-bit data as the reference voltage among 2m voltages obtained by dividing a difference between two voltages by 2m, the difference being represented by $\Delta V \times |G|/(1+|G|)$, provided that the lower-bit data are m bits (m is an integer of 1 or greater), that a gain of the inverting amplifier circuit is G, and that a voltage difference corresponding to one gradation of the gradation voltage is $\Delta V$.

2. An electro-optical device comprising:

the display driver according to claim 1, and an electro-optical panel that is driven by the display driver.

3. An electronic apparatus, comprising the display driver according to claim 1.

4. A display driver comprising:

a digital-to-analog (D/A) converter circuit configured to convert upper-bit data of display data to a gradation voltage corresponding to the upper-bit data;

a voltage output circuit to which lower-bit data of the display data are input; and an inverting amplifier circuit configured to amplify the gradation voltage and to drive a data line of an electro-optical panel, wherein the inverting amplifier circuit includes an operational amplifier in which a voltage obtained by dividing a voltage between the gradation voltage and an output voltage of the inverting amplifier circuit is input to an inverting input terminal, the operational amplifier includes first to p-th transistors (p is an integer of 2 or greater) that are coupled in parallel with each other as transistors of a differential pair corresponding to a non-inverting input terminal, the voltage output circuit is configured to select either one of a first reference voltage and a second reference voltage that is different from the first reference voltage as each of the output voltages of the first to p-th transistors based on the lower-bit data and to output the output voltages of the first to p-th transistors to gates of the first to p-th transistors, and a voltage difference between the first reference voltage and the second reference voltage is represented by $\Delta V \times |G|/(1+|G|)$ provided that the lower-bit data are m bits (m is an integer of 1 or greater), that a gain of the inverting amplifier circuit is G, and that a voltage difference corresponding to one gradation of the gradation voltage is $\Delta V$.

5. The display driver according to claim 4, wherein the inverting amplifier circuit includes a first resistor provided between an input node of the inverting amplifier circuit to which the gradation voltage is input and an inverting input terminal of the operational amplifier, and a second resistor provided between an output terminal of the operational amplifier and the inverting input terminal.

6. An electro-optical device comprising:

the display driver according to claim 4, and an electro-optical panel that is driven by the display driver.

7. An electronic apparatus, comprising the display driver according to claim 4.

* * * * *